US006709374B2

(12) United States Patent
Neubauer et al.

(10) Patent No.: US 6,709,374 B2
(45) Date of Patent: Mar. 23, 2004

(54) BOOKLET-FORMING MACHINE AND METHOD

(75) Inventors: William C. Neubauer, Grayslake, IL (US); Roger Mattila, Woodridge, IL (US)

(73) Assignee: Vijuk Equipment, Inc., Elmhurst, IL (US)

( * ) Notice: Subject to any disclaimer, the term of this patent is extended or adjusted under 35 U.S.C. 154(b) by 0 days.

(21) Appl. No.: 10/054,615

(22) Filed: Jan. 18, 2002

(65) Prior Publication Data

US 2003/0139275 A1 Jul. 24, 2003

(51) Int. Cl.[7] ..... B31B 1/26
(52) U.S. Cl. ..... 493/405; 493/424; 493/442
(58) Field of Search ..... 270/52.14, 58.07, 270/32, 37; 493/405, 424, 434, 442

(56) References Cited

U.S. PATENT DOCUMENTS

| | | | | |
|---|---|---|---|---|
| 1,239,965 A | | 9/1917 | Reinhold | |
| 1,326,859 A | | 12/1919 | Grammar | |
| 1,853,829 A | | 4/1932 | Maury | 283/34 |
| 2,751,222 A | | 6/1956 | Dexter | 270/81 |
| 2,862,624 A | | 12/1958 | Stokes | 281/21.1 X |
| 3,760,520 A | | 9/1973 | Hamilton | 40/102 |
| 3,773,314 A | | 11/1973 | Giovannini | 270/63 |
| 3,920,267 A | | 11/1975 | Lyon, Jr. | 281/16 |
| 4,010,299 A | | 3/1977 | Hershey, Jr. et al. | 40/310 X |
| 4,046,366 A | | 9/1977 | McCain et al. | 270/21 |
| 4,097,067 A | | 6/1978 | Schechter | 283/62 X |
| 4,229,926 A | | 10/1980 | Rowling | 53/429 |
| 4,270,742 A | | 6/1981 | Kobayashi | 270/37 |
| 4,279,409 A | | 7/1981 | Pemberton | 270/32 |
| 4,300,791 A | * | 11/1981 | Bohrer et al. | 283/38 |
| RE30,958 E | | 6/1982 | White | 40/310 |
| 4,583,763 A | | 4/1986 | Shacklett, Jr. | 281/2 X |
| 4,606,553 A | | 8/1986 | Nickerson | 281/5 |
| 4,616,815 A | | 10/1986 | Vijuk | 270/45 |
| 4,621,837 A | | 11/1986 | Mack | 283/105 |
| 4,637,633 A | | 1/1987 | Instance | 283/81 |
| 4,660,856 A | | 4/1987 | Shacklett, Jr. | 281/5 |
| 4,812,195 A | | 3/1989 | Vijuk | 156/357 |

(List continued on next page.)

FOREIGN PATENT DOCUMENTS

| | | |
|---|---|---|
| DE | 10939 | 9/1880 |
| DE | 31 25 369 | 6/1981 |
| DE | 93 08 759.4 | 9/1993 |
| DE | 93 08 760.8 | 9/1993 |
| DE | 198 18 160 | 4/1998 |
| FR | 744.196 | 10/1932 |
| FR | 1.403.865 | 5/1964 |
| GB | 28013 | 12/1907 |
| GB | 20385 | 10/1914 |
| GB | 1429868 | 5/1973 |

OTHER PUBLICATIONS

"Glue Scan–Integrated Glue Monitoring," brochure, hhs Gluing Systems.

*Primary Examiner*—Eugene Kim
(74) *Attorney, Agent, or Firm*—Marshall, Gerstein & Borun LLP

(57) ABSTRACT

An apparatus and method of forming a booklet having product information printed thereon is disclosed. The method may include: (a) providing a profiled sheet of paper having product information printed thereon; (b) applying an adhesive to a sheet of paper having product information printed thereon; (c) folding the profiled sheet after (b) by making a plurality of folds in the profiled sheet; (d) coupling one or more removable tabs together after (b) to maintain a plurality of inner sheet panels in a substantially closed position and/or (e) removing first and second folded edges of an intermediate article after (c).

24 Claims, 20 Drawing Sheets

U.S. PATENT DOCUMENTS 4,817,931 A 4/1989 Vijuk ..... 270/18
4,850,611 A * 7/1989 Skelton ..... 281/5
4,887,373 A 12/1989 Macaulay ..... 40/119
4,905,977 A 3/1990 Vijuk ..... 270/45
4,906,024 A 3/1990 Lein ..... 283/34 X
4,991,878 A 2/1991 Cowan et al. ..... 283/81
4,997,205 A 3/1991 Hansch ..... 281/2
5,044,873 A 9/1991 Vijuk ..... 414/712.5
5,046,710 A 9/1991 Vijuk ..... 270/37
5,074,595 A 12/1991 Hill et al. ..... 283/81
5,156,898 A 10/1992 McDonald ..... 428/130 X
5,234,231 A 8/1993 Hollander et al. ..... 281/2
5,234,735 A 8/1993 Baker et al. ..... 428/40
5,351,991 A 10/1994 McDonald ..... 281/5 X
5,403,636 A 4/1995 Crum ..... 428/40
5,439,721 A 8/1995 Pedroli et al. ..... 428/40
5,458,374 A 10/1995 Vijuk et al. ..... 281/2 X
5,605,730 A 2/1997 Treleaven ..... 327/386
5,655,866 A 8/1997 Bellanca ..... 412/1
5,667,210 A 9/1997 DeLise, Jr. ..... 270/37
5,685,530 A 11/1997 DeLise ..... 270/37
5,813,700 A 9/1998 Vijuk et al. ..... 283/81
5,909,899 A 6/1999 Vijuk et al. ..... 283/81
6,029,968 A 2/2000 Honegger ..... 270/37
6,056,321 A * 5/2000 Donley ..... 281/2
6,068,300 A 5/2000 Vijuk et al. ..... 283/67
6,095,512 A 8/2000 Vijuk et al. ..... 271/3.05
6,129,346 A * 10/2000 Zorn ..... 270/52.19
6,158,778 A 12/2000 Vijuk et al. ..... 283/67
6,273,411 B1 * 8/2001 Vijuk ..... 270/37
6,290,796 B2 9/2001 Furst et al. ..... 156/211
6,349,973 B1 2/2002 Vijuk et al. ..... 283/67
6,363,851 B1 * 4/2002 Gerhard et al. ..... 101/483
6,406,581 B1 * 6/2002 Furst et al. ..... 156/211

* cited by examiner

BOOKLET-FORMING MACHINE AND METHOD

BACKGROUND

This patent is directed to a booklet-forming machine and method for forming a booklet having printed information disposed thereon.

One patent that discloses such a booklet is U.S. Pat. No. 6,273,411 to Joseph M. Vijuk. The Vijuk patent discloses various methods of forming a booklet from a single sheet of paper. As shown in FIGS. 2A through 2G, the Vijuk patent discloses the formation of a booklet by first applying a strip of glue along the length of a sheet of paper having information printed thereon and then making a plurality of folds in the sheet of paper, with each of the folds being made in a direction perpendicular to the length of the sheet of paper. The formation of the booklet is completed by trimming off the folded portions of the folded sheet and then making a fold in a direction parallel to the strip of glue that coincides with the strip of glue. FIGS. 3A through 3D and FIGS. 4A through 4F of the Vijuk patent disclose additional methods of forming a booklet from a sheet of paper, and the Vijuk patent also discloses various embodiments of an apparatus for forming booklets from a sheet of paper.

SUMMARY OF THE INVENTION

In one aspect, the invention is directed to a method of forming a booklet having product information printed thereon. The method may include (a) providing a profiled sheet of paper having product information printed thereon. The profiled sheet may have a first sheet portion with a width transverse to the length of the profiled sheet, a second sheet portion having a width transverse to the length of the profiled sheet, and/or a pair of removable tabs formed from part of the second sheet portion. The first sheet portion may have a length parallel to the length of the profiled sheet, the second sheet portion may have a length parallel to the length of the profiled sheet, the length of the first sheet portion may be greater than the length of the second sheet portion, and/or the width of the second sheet portion may be greater than the width of the first sheet portion.

The method may also include (b) applying an adhesive to a sheet of paper having product information printed thereon and (c) folding the profiled sheet after (b) by making a plurality of folds in the profiled sheet in a first direction perpendicular to the length of the profiled sheet using a folding apparatus, which may comprise a plurality of folding rollers, to form an intermediate article. The intermediate article may comprise a plurality of inner sheet panels, an outer sheet panel that corresponds to the second sheet portion of the profiled sheet, a first folded edge parallel to the first direction, and/or a second folded edge parallel to the first direction. The folds may be made so that the outer sheet panel is not disposed between two of the sheet panels, and/or so that each of a plurality of the sheet panels is adhered to at least one other of the sheet panels by the adhesive along a bonded portion of the intermediate article. The method may also include (d) coupling the removable tabs together after (b) to maintain the inner sheet panels in a substantially closed position and/or (e) removing the first and second folded edges of the intermediate article after (c).

In another aspect, the invention is directed to a booklet-forming apparatus that forms a booklet having printed product information. The apparatus may include a first processing apparatus, which may comprise a cutting device, that provides a profiled sheet of paper having product information printed thereon, an adhesive applicator positioned to apply adhesive to a sheet of paper having product information printed thereon, and/or a first folding unit, which may comprise a plurality of folding rollers.

The first folding unit may make a plurality of folds in the profiled sheet in a first direction perpendicular to the length of the profiled sheet to form an intermediate article. The intermediate article may comprise a plurality of inner sheet panels, an outer sheet panel that corresponds to the second sheet portion of the profiled sheet, a first folded edge parallel to the first direction, and/or a second folded edge parallel to the first direction. The folds may be made so that the outer sheet panel is not disposed between two of the sheet panels and/or so that each of a plurality of the sheet panels is adhered to at least one other of the sheet panels by the adhesive along a bonded portion of the intermediate article disposed between a first end of the intermediate article and a second end of the intermediate article.

The booklet-forming apparatus may include a second processing apparatus, which may comprise a cutting device, that removes the first and second folded edges of the intermediate article and/or a second folding unit that may comprise a pair of folding rollers. The second folding unit may make a fold in the intermediate article along the bonded portion of the intermediate article and in a second direction perpendicular to the first direction. The fold in the intermediate article may be made so that the outer sheet panel forms a pair of outer sheets, so that each of the inner sheet panels forms a pair of inner sheets that are disposed between the outer sheets, and/or so that the removable tabs are coupled together to maintain the inner sheets in a substantially closed position.

Additional aspects of the invention will be apparent to those of ordinary skill in the art in view of the detailed description of various embodiments, which is made with reference to the drawings, a brief description of which is provided below.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, it is not intended that the scope of any claim element be interpreted based on the application of 35 U.S.C. §112, sixth paragraph.

Booklet Embodiments

Figure 1A:
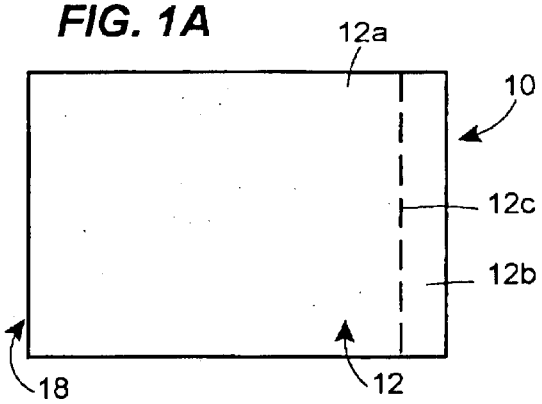
FIG. 1A is a top view of one embodiment of a booklet.
Figure 1B:
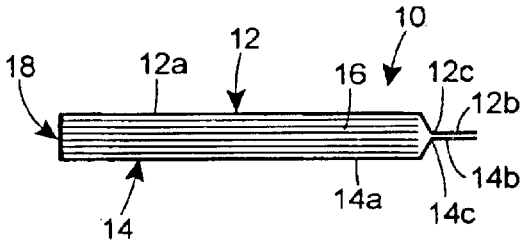
FIG. 1B is a side view of the booklet of FIG. 1A.

FIG. 1A is a top view of one possible embodiment of a booklet 10 that may be formed, and FIG. 1B is a side view of the booklet 10. Referring to FIGS. 1A and 1B, the booklet 10 may be provided with an upper outer sheet 12, a lower outer sheet 14, and a plurality of inner sheets 16 disposed between the outer sheets 12, 14. The upper outer sheet 12 may be composed of a main sheet portion 12*a* and a tab 12*b*, which may be joined to the main sheet portion 12*a* at a junction 12*c*. The lower outer sheet 14 may be composed of a main sheet portion 14*a* and a tab 14*b*, which may be joined to the main sheet portion 14*a* at a junction 14*c*. All of the sheets 12, 14, 16 may be bound together, such as adhesively bound, at a binding 18 that coincides with a side of the booklet 10.

The junctions 12*c*, 14*c* between the main sheet portions 12*a*, 14*a* and the tabs 12*b*, 14*b* may form weakened links, which may be perforations for example, in which case the tabs 12*b*, 14*b* may be removable from the booklet 10. The tabs 12*b*, 14*b* may be connected together, such as by being glued, for example, so that the booklet 10 may not be opened until the tabs 12*b*, 14*b* are removed from the booklet 10, such as by being ripped along the weakened links or perforations 12*c*, 14*c*. After removal of the tabs 12*b*, 14*b*, the booklet 10 may be opened just like a book so that the printed information, which may be disposed on each of the two pages of each of the sheets 12, 14, 16, may be read.

Various Methods of Forming Booklets

Figure 2A:
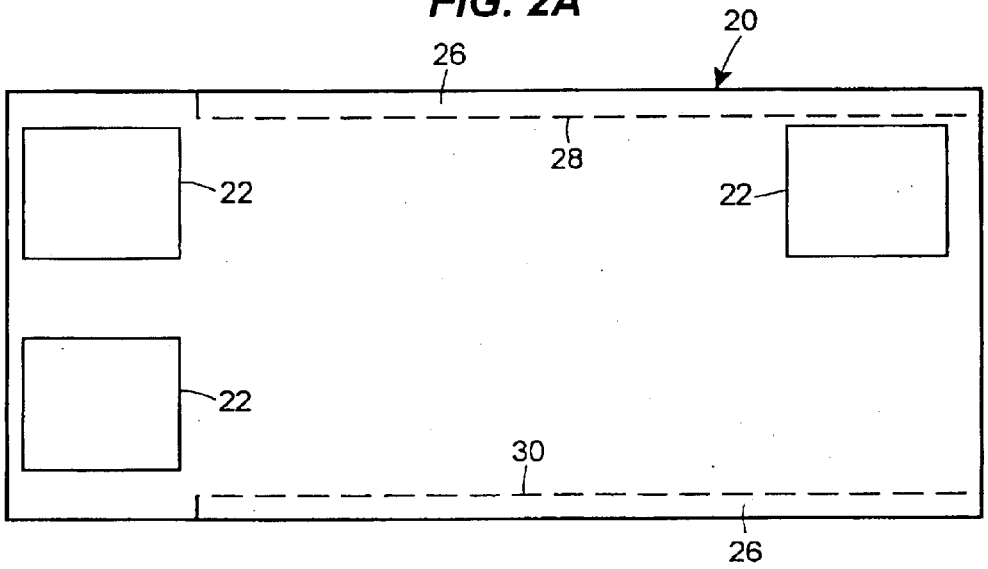
FIGS. 2A–2F are used to illustrate various ways in which the booklet of FIG. 1A may be formed.

FIGS. 2A–2F illustrate various intermediate stages of a booklet that may be formed by various methods. FIG. 2A illustrates a sheet of paper 20 having printed information, shown schematically at 22, on various portions of the sheet 20, which printed information 22 may relate to a pharmaceutical or drug product. Although the printed information 22 is shown disposed on only several portions of the sheet 20 for sake of simplicity, it should be understood that the printed information 22 may be disposed on more portions of the sheet 20, or on substantially all portions of the sheet 20.

As shown in FIG. 2A, the sheet of paper 20 may be rectangular in shape. If rectangular, the sheet of paper 20 may be transformed or converted into a profiled sheet 24 (FIG. 2B), which may be performed by removing one or more portions of the sheet of paper 20, such as a pair of elongate sheet portions designated 26 in FIG. 2A. That transformation may be done by removing the elongate sheet portions 26, such as by cutting for example, along a pair of L-shaped segments 28, 30 shown as dotted lines in FIG. 2A. Where L-shaped cuts are made, they may be made at the same time, or they may be made at different times. For example, a first pair of cuts may be made in a first direction on the sheet 20, and then a second pair of cuts may be made in a second direction on the sheet 20 perpendicular to the first direction.

Figure 2B:
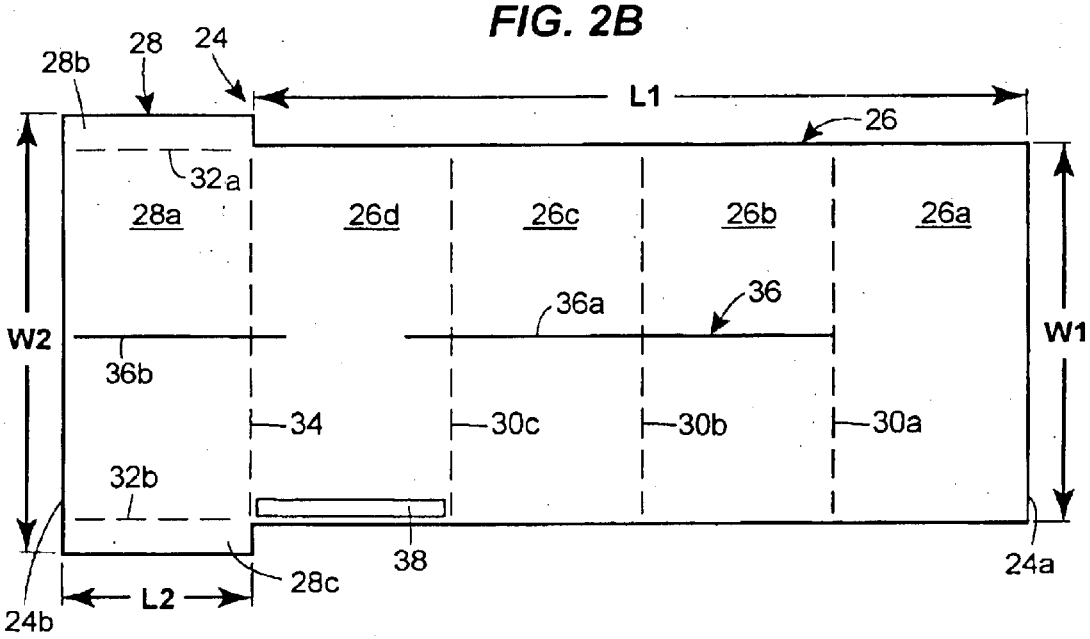

FIG. 2B illustrates the profiled sheet 24 that may be formed from the sheet of paper 20. Referring to FIG. 2B, the profiled sheet 24 may be provided with a first sheet portion 26 disposed adjacent an edge 24*a* of the profiled sheet 24 and a second sheet portion 28 disposed adjacent an edge 24*b* of the profiled sheet 24. The first sheet portion 26 may be provided with a dimension or length L1 that is parallel to the length of the profiled sheet 24, and the second sheet portion 28 may be provided with a dimension or length L2 that is parallel to the length of the profiled sheet 24. The length L1 of the first sheet portion 26 may be greater than the length L2 of the second sheet portion 28, in which case the first sheet portion 26 may be referred to as the long sheet portion 26 and the second sheet portion 28 may be referred to as the short sheet portion 28.

The first sheet portion 26 may be provided with a dimension or width W1 that is perpendicular to the length of the profiled sheet 24, and the second sheet portion 28 may be provided with a dimension or width W2 that is perpendicular to the length of the profiled sheet 24. The width W1 of the first sheet portion 26 may be smaller than the width W2 of the second sheet portion 28.

The long portion 26 of the profiled sheet 24 may include a plurality of sheet panels 26*a*–26*d*, each pair of which may be considered to be separated by a respective boundary, which boundaries are indicated in FIG. 2B by dotted lines 30*a*, 30*b*, 30*c*. Although FIG. 2B illustrates the profiled sheet 24 as having four sheet panels 26*a*–26*d*, the long sheet portion 26 of the profiled sheet 24 may be provided with different numbers of sheet panels, such as any number of sheet panels between two sheet panels and 10 sheet panels, or more than 10 sheet panels.

The short portion 28 of the profiled sheet 24 may be provided with a main sheet portion 28*a* and a pair of tab portions or tabs 28*b*, 28*c*. Each of the tabs 28*b*, 28*c* may be considered to be separated from the main sheet portion 28*a* by a respective one of a pair of weakened links 32*a*, 32*b*, which may be perforations or score lines, for example. Although the weakened links 32*a*, 32*b* are shown to be aligned with the upper and lower edges of the profiled sheet 24, the weakened links could be provided in different positions, such as at different points along the width W2 of the main sheet portion 28*a*. The main sheet portion 28*a* may be considered to be separated from the sheet panel 26*d* via a boundary indicated in FIG. 2B by a dotted line 34.

A bonding agent, such as adhesive, may be applied to the profiled sheet 24 along a line 36, which may be disposed between the upper and lower edges of the profiled sheet 24, such as in the middle of the profiled sheet 24. The bonding agent may be applied a continuously along the line 36, or it may be applied in any other way, such as by applying a plurality of separate glue drops or glue portions spaced along the line 36.

The bonding agent may be omitted from a portion of the line 36, such as by being applied along a first segment 36*a* and along a separate segment 36*b*. Such an application pattern may be used to form a booklet with a removable sheet or page. Where a bonding agent is applied along the two separate segments 36*a*, 36*b* shown in FIG. 2B, a removal sheet or page corresponding to the sheet panel 26*d* may be provided.

Where a removal sheet or page is provided, a portion of adhesive, which is designated 38 in FIG. 2B, may be applied to that sheet or page. The adhesive 38 may be provided so that, after the sheet or page is removed from the booklet, the person removing the sheet or page can fold the sheet or page in half (if not already folded) to form an article that remains in a closed or folded configuration due to the adhesive 38. The adhesive 38 may be a liquid-activated adhesive, such as the type used on envelopes.

The profiled sheet 24 shown in FIG. 2B may be transformed into a booklet by making a plurality of folds in the profiled sheet 24. The folds may include folds made in a first direction that is perpendicular to the length of the profiled sheet 24 and one or more folds made in a second direction parallel to the length of the profiled sheet 24. One or more of the folds in the first direction may be made after the weakened links 32*a*, 32*b* are formed (if used) and after the adhesive 38 is applied (if used).

Figure 2C:
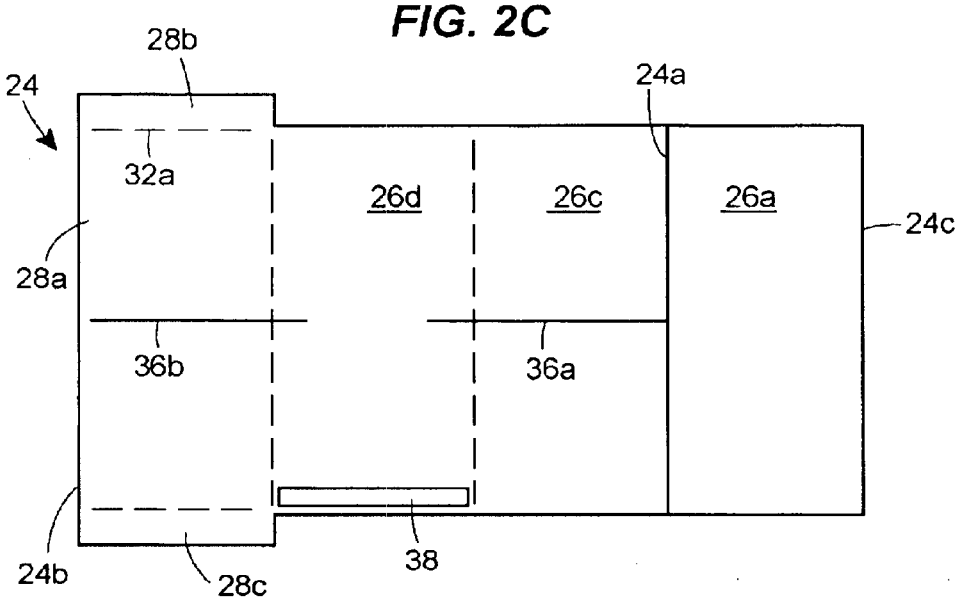

FIG. 2C illustrates the profiled sheet 24, which may also be referred to as an intermediate article 24, after a first fold is made in the profiled sheet 24 in a direction perpendicular to the length of the profiled sheet 24. The first fold may be made by folding the sheet panel 26*a* over the sheet panel 26*b* along a fold line that coincides with the dotted line 30*a* shown in FIG. 2B. Where adhesive is applied along the segment 36*a* shown in FIG. 2B, the sheet panels 26*a* and 26*b* will be adhered together after the first fold is made. As a result of the first fold, the intermediate article 24 may have a folded edge 24*c*.

Figure 2D:
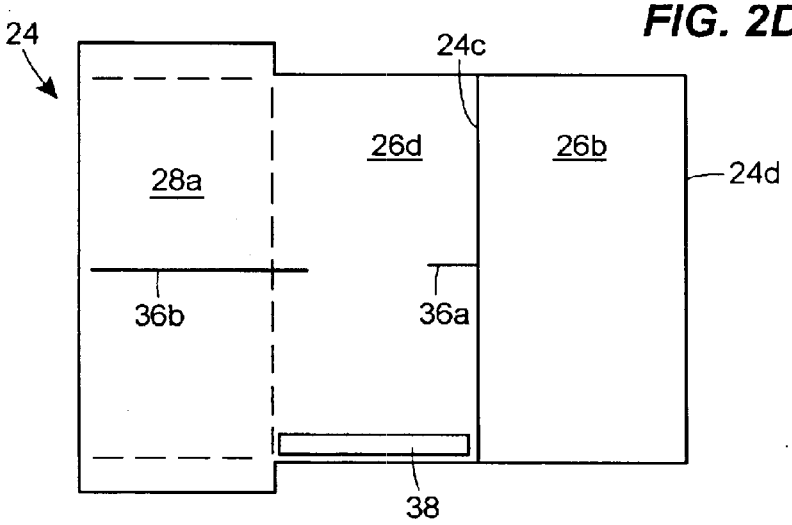

FIG. 2D illustrates the intermediate article 24 after a second fold is made in the profiled sheet 24 in a direction perpendicular to the length of the profiled sheet 24. The second fold may be made by folding the sheet panels 26*a*–26*b* over the sheet panel 26*c* along a fold line that coincides with the dotted line 30*b* shown in FIG. 2B. Where adhesive is applied along the segment 36*a* shown in FIG. 2B, the sheet panel 26*a* will be adhered to the sheet panel 26*c* after the second fold is made. As a result of the second fold, the intermediate article 24 may have a folded edge 24*d*.

Figure 2E:
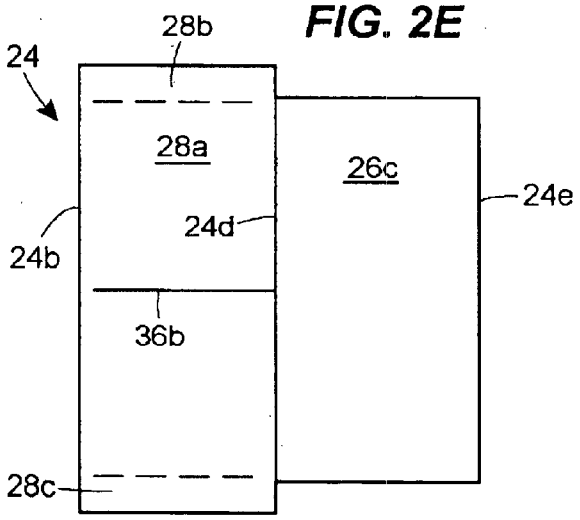

FIG. 2E illustrates the intermediate article 24 after a third fold is made in the profiled sheet 24 in a direction perpendicular to the length of the profiled sheet 24. The third fold may be made by folding the sheet panels 26*a*–26*c* over the sheet panel 26*d* along a fold line that coincides with the dotted line 30*c* shown in FIG. 2B. Where adhesive is applied along the particular segments 36*a*, 36*b* shown in FIG. 2B, the sheet panel 26*b* will be partially adhered to the sheet panel 26*d* after the third fold is made. As a result of the third fold, the intermediate article 24 may have a folded edge 24*e*.

Figure 2F:
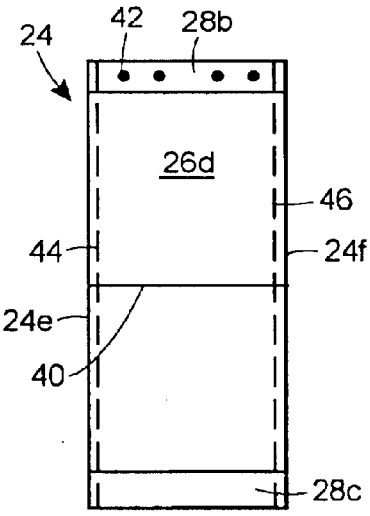

FIG. 2F illustrates the intermediate article 24 after a fourth fold is made in the profiled sheet 24 in a direction perpendicular to the length of the profiled sheet 24. The fourth fold may be made by folding the sheet panels 26*a*–26*d* over the sheet panel 28*a* along a fold line that coincides with the dotted line 34 shown in FIG. 2B. Where adhesive is applied along the segment 36*b* shown in FIG. 2B, the sheet panel 26*c* will be adhered to the sheet panel 28*a* after the fourth fold is made. After the fourth fold is made, the intermediate article 24 may have a folded edge 24*f*, the tabs 28*b*, 28*c* may be disposed beyond the sheet panels 26*a*–26*d*, and the sheet panel 28*a* may lie underneath each of the sheet panels 26*a*–26*d*.

A booklet may be formed from the intermediate article 24 shown in FIG. 2F by making a fold in the intermediate article 24 along a line 40 in a direction perpendicular to the direction in which the prior folds were made and removing the side portions of the intermediate article 24. Prior to making the fold along the line 40, a score may be made along that line to help facilitate the fold being made, and one or more portions of a bonding agent, such as adhesive, may be applied to one of the tabs 28*b*, 28*c*.

Before or after the fold along the line 40 is made, the side portions of the intermediate article 24 may be removed, such as by trimming or cutting to allow the sheet panels 26*a*–26*d*, 28*a* to become separated so that they can be moved relative to each other like the pages of a book. The removal of the side portions may occur along a pair of dotted lines 44, 46 shown in FIG. 2F. Removal of the right-hand side portion of the intermediate article 24 along the line 46 may result in removal of the right-hand folded edge 24*f*, and removal of the left-hand side portion of the intermediate article 24 along the line 44 may result in removal of the left-hand folded edge 24*e* and a portion of the unfolded edge 24*b* of the profiled sheet 24.

After a fold is made along the line 40 and after the side portions of the intermediate article 24 are removed, a booklet will be formed. Where the acts shown in FIGS. 2B–2F are utilized, the booklet will have a plurality of inner sheets or pages (like the inner pages 16 of FIG. 1) that correspond to the sheet panels 26*a*–26*d* and a pair of outer sheets or pages (like the outer pages 12, 14 of FIG. 1) that correspond to the sheet panel 28*a*. The inner and outer sheets or pages will be bound together at a binding (like the binding 18 of FIG. 1) along the line 40, and the tabs 28*b*, 28*c* will be bound together and will act to maintain the inner and outer sheets or pages in a closed position. Removal of the tabs 28*b*, 28*c* from the booklet will allow the inner and outer sheets or pages to be manipulated and turned like the pages of a book.

Instead of using portions of the adhesive 42 to couple the tabs 28*b*, 28*c* together, a closure member (not shown), such as a circularly shaped piece of adhesive-backed paper, may be applied to the tabs 28*b*, 28*c* after the fold is made along the line 40.

Additional or different methods and/or acts, such as particular folding patterns and methods, that could be used to form a booklet are disclosed in U.S. Pat. No. 6,273,411 to Joseph Vijuk, which patent is incorporated herein by reference in its entirety. For example, the glue pattern and/or folding acts shown and described in connection with FIGS. 3A–3D of the '411 Vijuk patent could be utilized. Alternatively, the glue pattern and/or folding acts shown and described in connection with FIGS. 4A–4F of the '411 Vijuk patent could be utilized. Also, the glue pattern and/or folding acts shown and described in connection with FIG. 5 of the '411 Vijuk patent could be utilized.

FIGS. 2A–2F illustrate the formation of a booklet that can be considered to have 20 pages, where each of the sheet panels 26*a*–26*d* and 28*a* corresponds to four pages. If the number of folds along the dotted lines 30*a*–30*c* is varied, booklets having different numbers of pages could be formed. For example, a booklet having eight pages may be produced if only one fold is made in a direction parallel to the dotted line 30*a* (assuming a final fold is then made in a perpendicular direction). A booklet having twelve pages may be produced if two folds are made in a direction parallel to the dotted line 30*a*. A booklet having sixteen pages may be produced if three folds are made in a direction parallel to the dotted line 30*a*. A booklet having twenty-four pages may be produced if five folds are made in a direction parallel to the dotted line 30*a*. A booklet having twenty-eight pages may be produced if six folds are made in a direction parallel to the dotted line 30*a*. A booklet having thirty-two pages may be produced if seven folds are made in a direction parallel to the dotted line 30*a*. A booklet having thirty-six pages may be produced if eight folds are made in a direction parallel to the dotted line 30*a*.

Figure 3A:
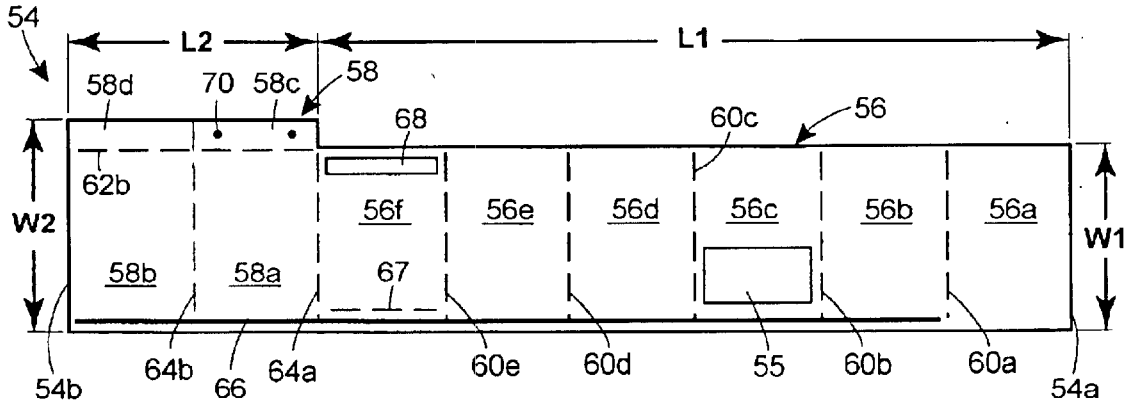
FIGS. 3A–3D are used to illustrate various ways in which the booklet of FIG. 1A may be formed.

FIGS. 3A–3D illustrate various intermediate stages of a booklet that may be formed by various methods. FIG. 3A illustrates a profiled sheet of paper 54 having printed information, shown schematically at 55, on various portions of the sheet 54, which printed information 55 may relate to a pharmaceutical or drug product. Although the printed information 55 is shown disposed on only one portion of the sheet 54 for sake of simplicity, it should be understood that the printed information 55 may be disposed on more portions of the sheet 54, or on substantially all portions of the sheet 54. The profiled sheet 54 may be formed from a rectangular sheet of paper by removing one or more portions of the rectangular sheet of paper, such as a pair of elongate sheet portions. That formation may be made in the same or a similar manner as described above in connection with the profiled sheet 24.

Referring to FIG. 3A, the profiled sheet 54 may be provided with a first sheet portion 56 disposed adjacent an edge 54*a* of the profiled sheet 54 and a second sheet portion 58 disposed adjacent an edge 54*b* of the profiled sheet 54. The first sheet portion 56 may be provided with a dimension or length L1 that is parallel to the length of the profiled sheet 54, and the second sheet portion 58 may be provided with a dimension or length L2 that is parallel to the length of the profiled sheet 54. The length L1 of the first sheet portion 56 may be greater than the length L2 of the second sheet portion 58, in which case the first sheet portion 56 may be referred to as the long sheet portion 56 and the second sheet portion 58 may be referred to as the short sheet portion 58.

The first sheet portion 56 may be provided with a dimension or width W1 that is perpendicular to the length of the profiled sheet 54, and the second sheet portion 58 may be provided with a dimension or width W2 that is perpendicular to the length of the profiled sheet 54. The width W1 of the first sheet portion 56 may be smaller than the width W2 of the second sheet portion 58.

The long portion 56 of the profiled sheet 54 may include a plurality of sheet panels 56*a*–56*f*, each pair of which may be considered to be separated by a respective boundary, which boundaries are indicated in FIG. 3A by dotted lines 60*a*–60*e*. Although FIG. 3A illustrates the profiled sheet 54 as having six sheet panels 56*a*–56*f*, the long sheet portion 56 of the profiled sheet 54 may be provided with different numbers of sheet panels, such as any number of sheet panels between two sheet panels and 10 sheet panels, or more than 10 sheet panels.

The short portion 58 of the profiled sheet 54 may be provided with a plurality of main sheet portions 58*a*, 58*b* and a pair of tab portions or tabs 58*c*, 58*d*. Each of the tabs 58*c*, 58*d* may be considered to be separated from one of the main sheet portions 58*a*, 58*b* by a respective one of a pair of weakened links 62*a*, 62*b*, which may be perforations or score lines, for example. Although the weakened links 62*a*, 62*b* are shown to be aligned with the upper edge of the profiled sheet 54, the weakened links could be provided in different positions, such as at a different point along the width W2 of the main sheet portions 58*a*, 58*b*. The main sheet portions 58*a*, 58*b* may be considered to be defined via a pair of boundaries indicated in FIG. 3A by a pair of dotted lines 64*a*, 64*b*.

A bonding agent, such as adhesive, may be applied to the profiled sheet 54 along a line 66, which may be disposed adjacent one of the upper and lower edges of the profiled sheet 54. The bonding agent may be applied a continuously along the line 66, or it may be applied in any other way, such as by applying a plurality of separate glue drops or glue portions spaced along the line 66.

A removable page may be provided by forming a weakened link, such as a perforation or score line, that spans all or a portion of the removable page, as indicated in FIG. 3A by a dotted line 67 shown on the sheet panel 56*f*.

Where a removal sheet or page is provided, a portion of adhesive, which is designated 68 in FIG. 3A, may be applied to that sheet or page. The adhesive 68 may be provided so that, after the sheet or page is removed from the booklet, the person removing the sheet or page can fold the sheet or page in half (if not already folded) to form an article that remains in a closed or folded configuration due to the adhesive 68. The adhesive 68 may be a liquid-activated adhesive, such as the type used on envelopes.

A bonding agent 70 may be applied to one of the tabs 58*c*, 58*d* so that, when the profiled sheet 54 is folded to form a booklet, the tabs 58*c*, 58*d* will be coupled together to maintain the booklet in a closed position. The profiled sheet 54 shown in FIG. 3A may be transformed into a booklet by making a plurality of folds in the profiled sheet 54 in a direction that is perpendicular to the length of the profiled sheet 54. One or more of the folds may be made after the weakened links 62*a*, 62*b* are formed (if used) and after the adhesive 68 is applied (if used).

Figure 3B:
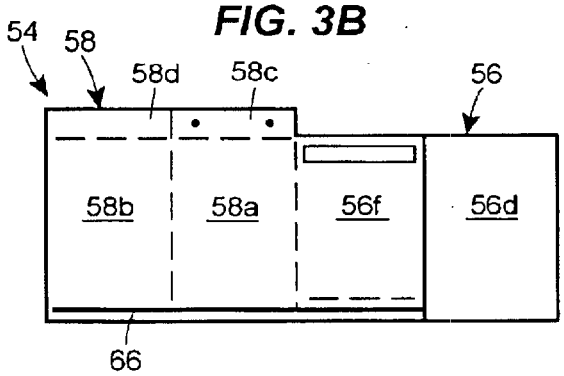

FIG. 3B illustrates the profiled sheet 54, which may also be referred to as an intermediate article 54, after four folds coinciding with the dotted lines 60*a*–60*d* are made in the profiled sheet 54. Where a bonding agent is applied along the entire line 66 shown in FIG. 3A, the sheet panels 56*a*–56*e* will be adhered together after the four folds are made.

Figure 3C:
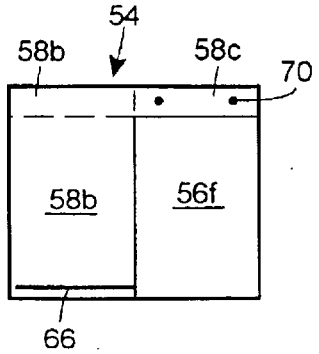

FIG. 3C illustrates the intermediate article 54 after six folds coinciding with the dotted lines 60*a*–60*e*, 64*a* are made. Where a bonding agent is applied along the entire line 66 shown in FIG. 3A, the sheet panels 56*a*–56*f*, 58*a* will be adhered together after the six folds are made.

Figure 3D:
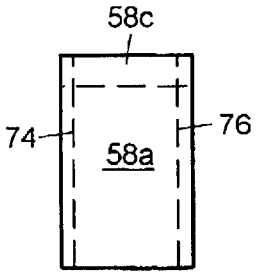

Referring to FIG. 3D, the intermediate article 54 may be transformed into a booklet by making an additional fold along the dotted line 64*b* (FIG. 3A) and by removing the side portions or folded side edges of the intermediate article 54 along a pair of dotted lines 74, 76.

Where the acts shown in FIGS. 3A–3D are utilized, the booklet will have a plurality of inner sheets or pages (like the inner pages 16 of FIG. 1) that correspond to the sheet panels 56*a*–56*f* and a pair of outer sheets or pages (like the outer pages 12, 14 of FIG. 1) that correspond to the sheet panels 58*a*, 58*b*. The inner and outer sheets or pages will be bound together at a binding (like the binding 18 of FIG. 1) along the line 66, and the tabs 58*c*, 58*d* will be bound together and will act to maintain the inner and outer sheets or pages in a closed position. Removal of the tabs 58*c*, 58*d* from the booklet will allow the inner and outer sheets or pages to be manipulated and turned like the pages of a book.

Instead of using portions of the adhesive 70 to couple the tabs 58*c*, 58*d* together, a closure member (not shown), such as a circularly shaped piece of adhesive-backed paper, may be applied to the tabs 58*c*, 58*d* after the final fold is made.

Folded Booklets

Figure 4A:
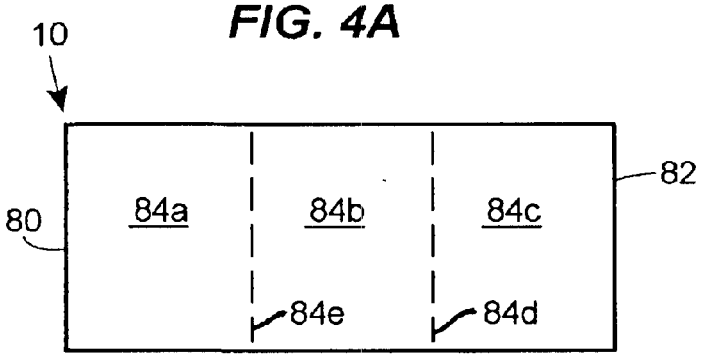
FIGS. 4A–4D illustrate how a booklet may be folded to form a closed booklet.
Figure 4B:
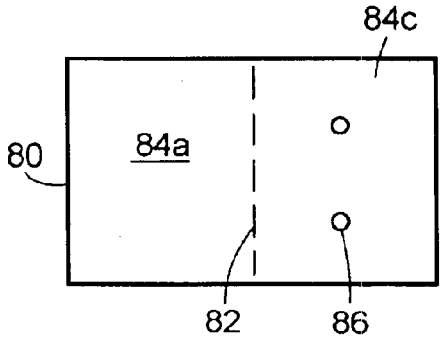
Figure 4C:
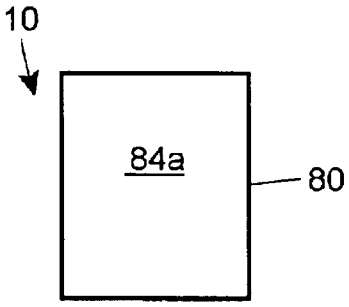
Figure 4D:
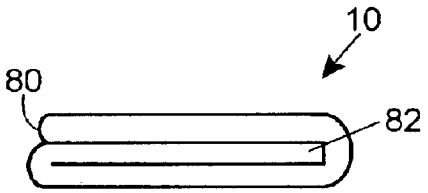

Any booklet 10 formed from any of the methods described herein can be transformed into a folded booklet by making one or more folds in the booklet after it is formed. FIG. 4A illustrates a booklet 10 having a first side 80 that may coincide with a binding and a second side 82 opposite the first side. The booklet 10 may be considered to have a number of panels 84*a*, 84*b*, 84*c* the boundaries of which may be defined by a number of dotted lines 84*d*, 84*e* shown in FIG. 4A. The booklet 10 may be transformed into a folded booklet by folding the panel 84*c* over the panel 84*b* along a fold line coinciding with dotted line 84*d* and applying one or more portions of adhesive 86 to the sheet panel 84*c* as shown in FIG. 4B, and then folding the sheet panel 84*a* over the sheet panel 84*c* so that the adhesive 86 bonds the two sheet panels 84*a*, 84*c* together. Other methods of folding the booklet 10 could be utilized.

Bonded Booklet Stacks

Figure 5:
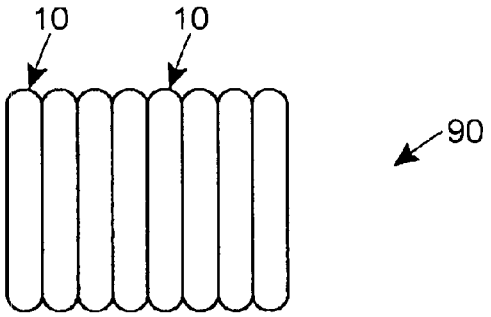
FIG. 5 is a side view of a stack of closed booklets bonded together.

Referring to FIG. 5, a plurality of booklets 10 may be bonded together to form a bonded booklet assembly or stack 90. The booklets 10 may be bonded together by applying an adhesive to one face or panel of each of the booklets 10, and then making adjacent faces or panels of each booklet 10 come into contact. The bonded stacks 90 may be formed to include predetermined numbers of booklets, such as 20 booklets per stack 90. The booklets 10 may be bonded together via an adhesive that allows one of the booklets 10 to be manually removed from the stack 90 so that the removed booklet 10 may be inserted into a box or carton containing a pharmaceutical item or drug.

Booklet Forming Machine Embodiments

Figure 6A:
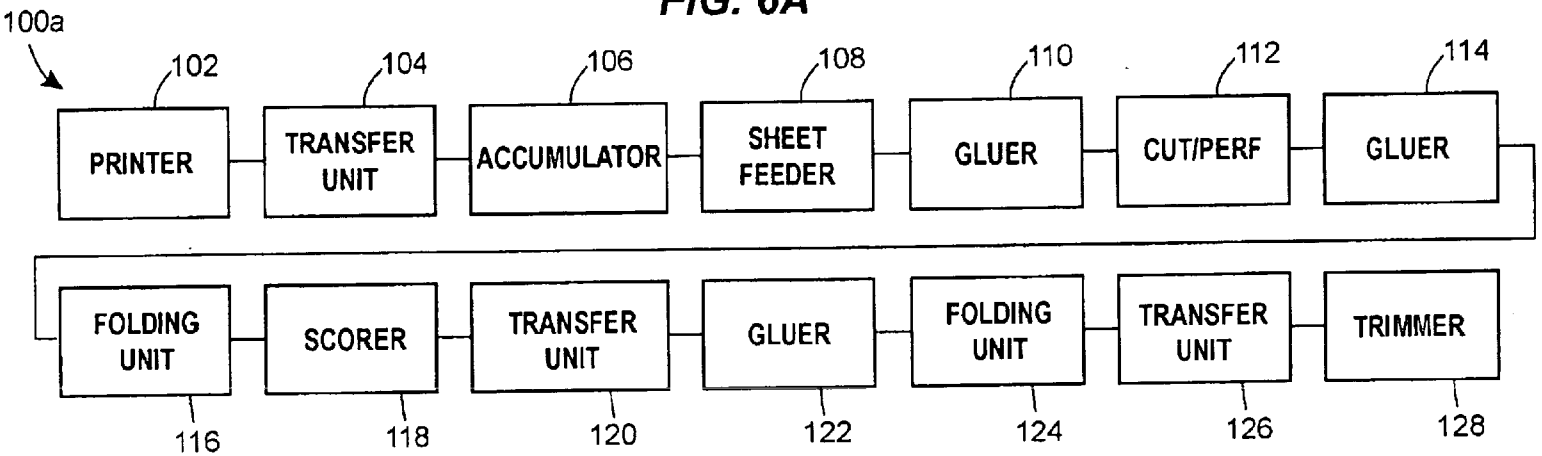
FIG. 6A is a block diagram representing various embodiments of a booklet-forming machine.

FIG. 6A is a block diagram representing various embodiments of a booklet-forming machine 100*a*, which may be used to perform the booklet-forming methods described above. Referring to FIG. 6A, the machine 100*a* may include a printer 102, which may be in the form of a web printer that prints textual subject matter on a paper web (not shown) provided to the printer 102 and cuts the paper web into individual sheets after it is printed. The printer 102 may produce a stream of printed sheets which may be provided to a sheet transfer unit 104. The stream of sheets provided by the printer 102 may be in the form of a shingled stream, in which case the sheets may overlap each other.

The transfer unit 104 may act to provide or transfer the sheets to an accumulator station 106, at which the sheets may temporarily accumulate in a stack of sheets. The sheets provided by the transfer unit 104 may be rectangular sheets, such as the sheet 20 shown in FIG. 2A, or profiled sheets, such as the profiled sheet 24 shown in FIG. 2B or the profiled sheet 54 shown in FIG. 3A. The accumulator station 106 may be designed to accumulate sheets due to differences in the sheet processing capacity between the printer 102 and one or more downstream processing units. The accumulator 106 may be operatively coupled to an automatic sheet feeder 108, which may act to periodically remove a sheet from the accumulator 106. The sheet feeder 108 may provide sheets to a gluing apparatus 110, which may be used to apply one or more portions of adhesive or another bonding agent to the sheets. For example, where the adhesive portion 38 (FIG. 2B) or the adhesive portion 68 (FIG. 3A) is used, the gluing apparatus 110 may deposit such adhesive portion.

The sheets may be provided to a cutting and/or perforation-forming apparatus 112, which may be used to form one or more cuts and/or one or more perforations in each of the sheets. For example, where the transfer unit 104 provides rectangular sheets, the rectangular sheets may be transformed into profiled sheets by the apparatus 112 by forming a pair of relatively long cuts (e.g. along the lines 28, 30 in FIG. 2A) in each sheet and/or a pair of short cuts in each sheet. The apparatus 112 may also form one or more perforations in each sheet, such as the perforations 32*a*, 32*b* shown in FIG. 2B or a perforation coinciding with the lines 62*a*–62*b* in FIG. 3A.

The sheets may be provided to a gluing apparatus 114 that deposits an adhesive or other bonding agent to the sheets, such as by depositing adhesive along the lines 36*a*, 36*b* of FIG. 2B or along the line 66 of FIG. 3A. The sheets may then be provided to a folding unit 116 that may make a plurality of folds in a first direction, such as in a direction perpendicular to the length of the sheets. Each folded sheet, which may be referred to as an intermediate article or a folded article, may then be automatically conveyed to a scoring apparatus 118, which may be used to make a score line in each article like the score line 40 (FIG. 2F) to facilitate the further folding of the article. The articles may then be automatically conveyed by a transfer unit 120 to a gluing apparatus 122, which may be used to apply one or more portions of adhesive to the article, such as the adhesive portions 42 shown in FIG. 2F, and then to a folding unit 124 which may make one or more further folds in each article, such as the fold along the fold line 40 shown in FIG. 2F or one of the folds described above in connection with FIGS. 4A–4C. Each article may then be automatically transferred by a transfer unit 126 to a trimming unit 128, which may be used to remove the folded side portions of the article.

It should be understood that the block diagram of the apparatus 100*a* shown in FIG. 6A is used to schematically represent the apparatus 100*a* to facilitate description of various possible embodiments and that the use of separate blocks does not necessarily mean that the underlying structure is separate. For example, while FIG. 6A shows three blocks 110, 112, 114 in a particular order, the functions of those three blocks 110, 112, 114 could be combined in a single processing apparatus. For example, such a processing apparatus could have a single glue applicator or nozzle that was controlled to perform all the necessary glue application, and the glue nozzle could be mounted to a cutting/perforation apparatus. Alternatively, the functionality of the blocks 114 and 116 could be combined by mounting a glue nozzle onto a folding apparatus.

It should also be understood that, to the extent that the order of the blocks shown in FIG. 6A suggests a particular arrangement of machine components, the order of the machine components could be changed. For example, although FIG. 6A shows the block representing the folding unit 124 before the block representing the trimming unit 128, the trimming unit 128 could be positioned before the folding unit 124. Similarly, the order or positions of the scoring unit 118 and the gluing apparatus 122 (assuming both were used) could be reversed, and the machine components representing the functions of the blocks 110, 112, 114 could be provided in any order.

Figure 6B:
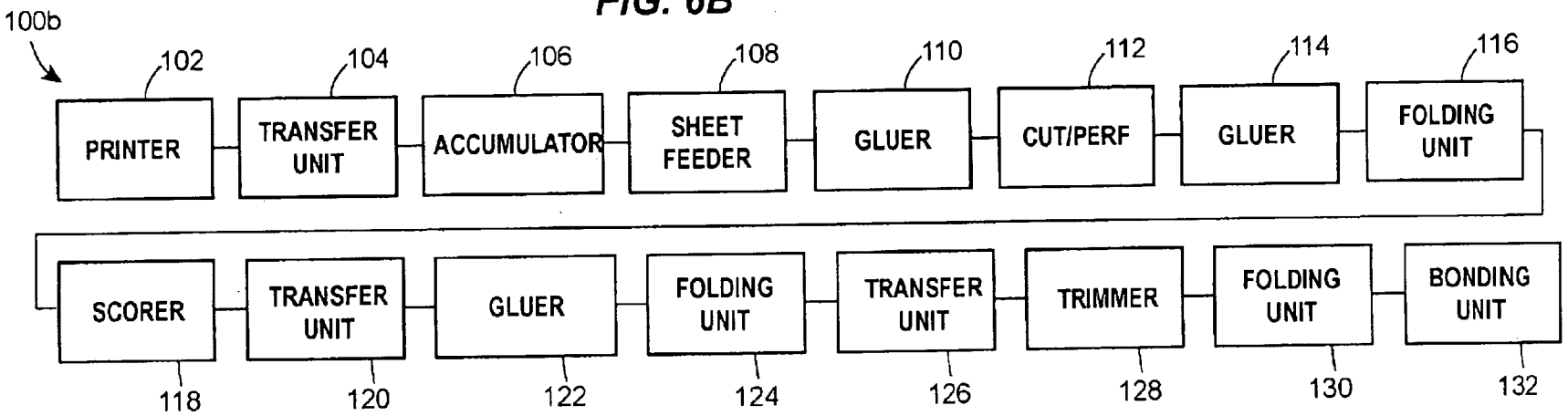
FIG. 6B is a block diagram representing various embodiments of a booklet-forming machine.

FIG. 6B is a block diagram representing various additional embodiments of a booklet forming machine 100*b*. The apparatus 100*b* of FIG. 6B may be identical to the apparatus 100*a* described above in connection with FIG. 6A, except that the apparatus 100*b* may also incorporate a folding unit 130 and/or a bonding unit 132. The folding unit 130 may be used to make one or more folds described above in connection with FIGS. 4A–4C to form a folded booklet, and the bonding unit 132 may be used to provide bonded booklet stacks 90 of the type shown in FIG. 5.

Figure 6C:
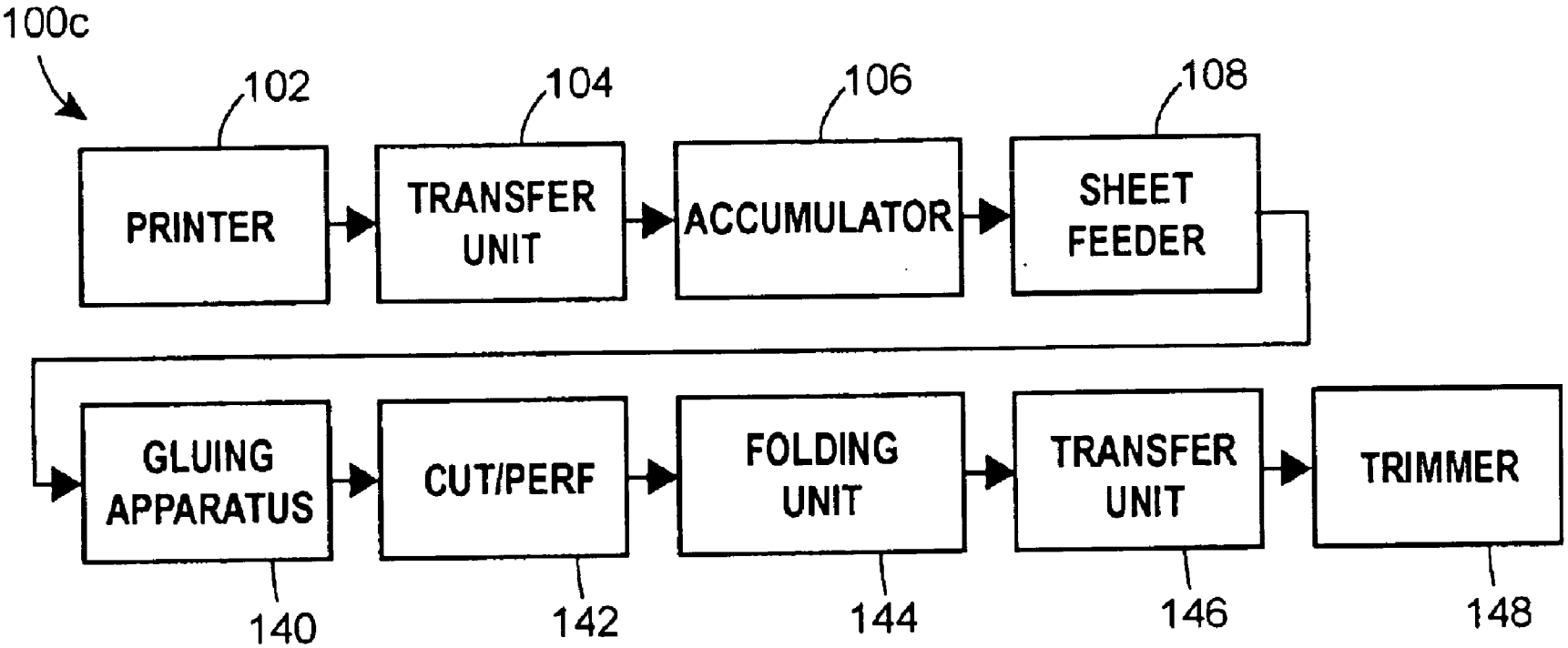
FIG. 6C is a block diagram representing various embodiments of a booklet-forming machine.

FIG. 6C is a block diagram representing various additional embodiments of a booklet forming machine 100*c* that may be used to perform the methods of forming a booklet described above in connection with FIGS. 3A–3D. The machine components 102–108 of the apparatus 100*c* of FIG. 6B may be identical to the corresponding components of the apparatus 100*a* described above in connection with FIG. 6A.

The machine 100*c* may be provided with a gluing apparatus 140, which may include one or more glue nozzles, that may be used to apply adhesive along the line 66 (see FIG. 3A) and/or to apply the adhesive 68, and/or to apply the adhesive 70. The machine 100*c* may include a cutting and/or perforation-forming apparatus 142 that may be used to make one or more cuts to form the profiled sheet 54 and to form the perforations 62*a*, 62*b* and/or 67. It should be understood that, although the blocks 140, 142 are shown in FIG. 6C as separate blocks and in a particular order, their functionality may be combined in one processing apparatus, or if multiple processing apparatuses are used, they may be provided in a different order. For example, the cut/perf apparatus 142 could be provided before the gluing apparatus 140.

The machine 100*c* may include a folding unit 144 that may make the folds described above in connection with FIGS. 3A–3C, a transfer unit 146, and a trimming unit 148 that may remove the sides of folded articles as described above in connection with FIG. 3D. The folding unit 144, the transfer unit 146, and the trimming unit 148 may be identical or similar to the folding unit 116, the transfer unit 104, and the trimming unit 108, respectively, described above in connection with FIG. 6A.

Transfer Unit

Figure 7:
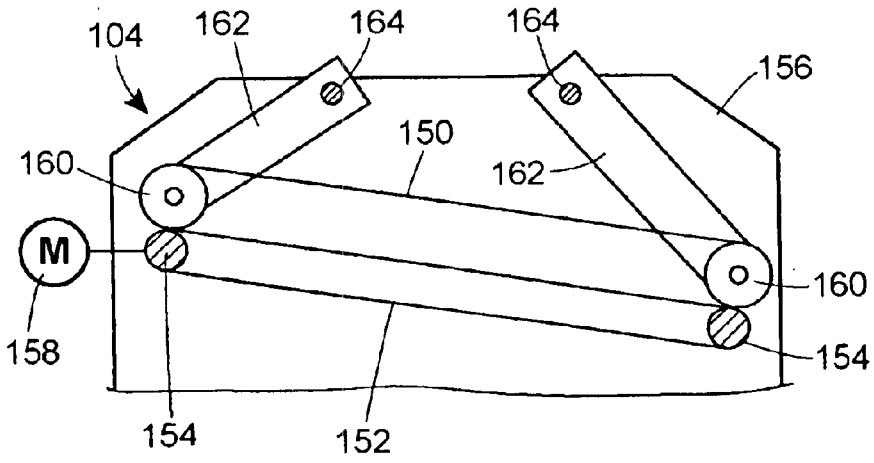
FIG. 7 is a side view of one possible embodiment of a transfer unit.

FIG. 7 is a side view of a portion of one possible embodiment of the sheet transfer unit 104 shown schematically in FIGS. 6A–6C. The transfer units 120, 126 (FIG. 6A) and the transfer unit 146 (FIG. 6C) may be identical to the transfer unit 104 described below.

Referring to FIG. 7, the transfer unit 104 may have a plurality of upper conveyor belts 150 and lower conveyor belts 152 between which the stream of sheets from the printer 102 may pass. The lower belts 152, which may be in the form of flat belts composed of fabric having a non-slip coating, may be supported by a plurality of rotatable metal rods 154 supported by a pair of frame members 156 (only one of which is shown), at least one of the rods 154 being rotatably driven by a motor shown schematically at 158.

The upper belts 150, which may be composed of rubber and which may have a circular cross section, may be supported by a plurality of rollers 160, each of which may be rotatably supported by a respective pivot arm 162 connected to one of a pair of pivot rods 164 supported between the frame members 156. The upper belts 160 may be sized so that, when they are placed onto the rollers 160, the tension of the upper belts 150 forces the pivot arms 162 downwards so that the upper belts 150 and the lower belts 152 make sufficiently firm contact with the stream of sheets to ensure that the sheets do not move relative to one another as they are transferred from the printer 102 to the accumulator station 106 by the transfer unit 104.

Accumulator Station 106

Figure 8A:
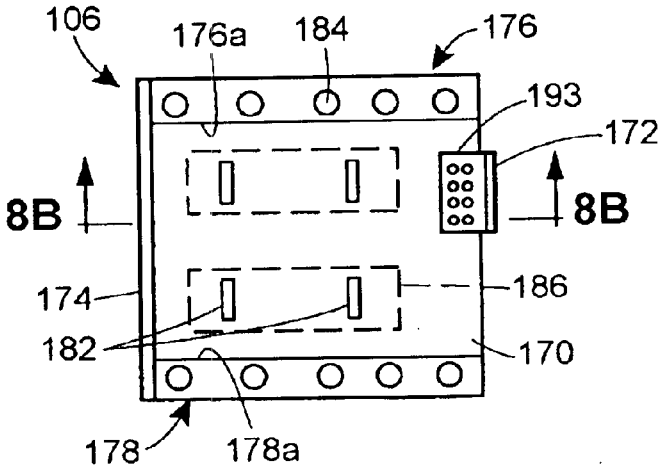
FIG. 8A is a top view of one possible embodiment of an accumulator station.
Figure 8B:
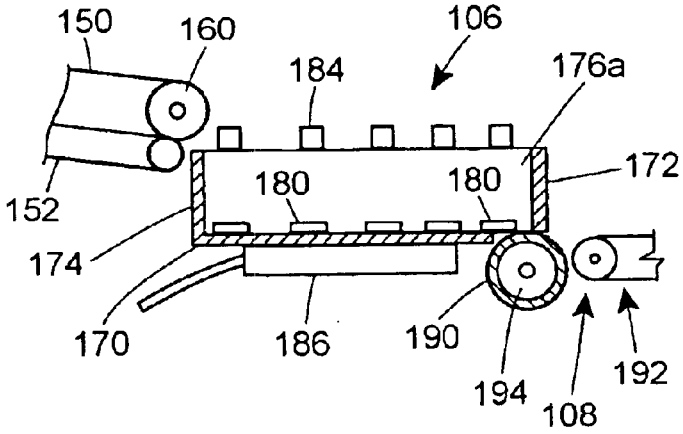
FIG. 8B is a cross-sectional side view of the accumulator station of FIG. 8A taken along lines 8B—8B of FIG. 8A.

FIGS. 8A and 8B illustrate one possible embodiment of the accumulator station 106 shown schematically in FIGS. 6A–6C. Referring to FIGS. 8A and 8B, the accumulator station 106 may have a flat base plate 170, a front plate 172, a rear wall 174, and a pair of elongate hexahedral side members 176, 178 each having a respective inner side surface 176*a*, 178*a*. As shown in FIG. 8B, the upper and lower conveyor belts 150, 152 of the transfer unit 104 may be positioned so as to deposit sheets into the hexahedral space defined by the base plate 170, the front plate 172, the rear wall 174, and the side surfaces 176*a*, 178*a*.

Pressurized air may be forced against the lower portion of the stack of sheets in the accumulator station 106 to slightly levitate the lowermost sheets to reduce the coefficient of friction between the lowermost sheet in the stack and the base plate 170 and/or to provide slight physical separation between the lowermost sheets in the stack. The pressurized air may be provided by a number of apertures 180 formed in each of the inner side surfaces 176*a*, 178*a* and/or a number of apertures 182 formed in the base plate 170.

The side members 176, 178, which may act as pneumatic pressure manifolds, may have a hollow interior which is divided into a number of individual pressure compartments, each of which may be pneumatically coupled to a source of pressurized air (not shown) and to a respective one of the apertures 180 in the side surfaces 176*a*, 178*a*. The pressure of the air provided through each aperture 180 may be varied by a respective regulator knob 184 associated with each of the pressure compartments by an internal valve structure shown and described in U.S. Pat. No. 4,616,815 to Michael Vijuk, the disclosure of which is incorporated herein by reference.

Pressurized air may be provided to the apertures 182 formed in the base plate 170 via one or more pressure manifolds 186 disposed beneath the base plate 170. Pressurized air may also be provided through a number of apertures (not shown) formed in the rear wall 174. The particular design of the accumulator station 106 described above is not considered important to the invention, and other designs could be used. Sheet transfer units, accumulator stations, and automatic folding machines of the type described above are commercially available from Vijuk Equipment Co. of Elmhurst, Ill.

Sheet Feeder 108

Figure 9A:
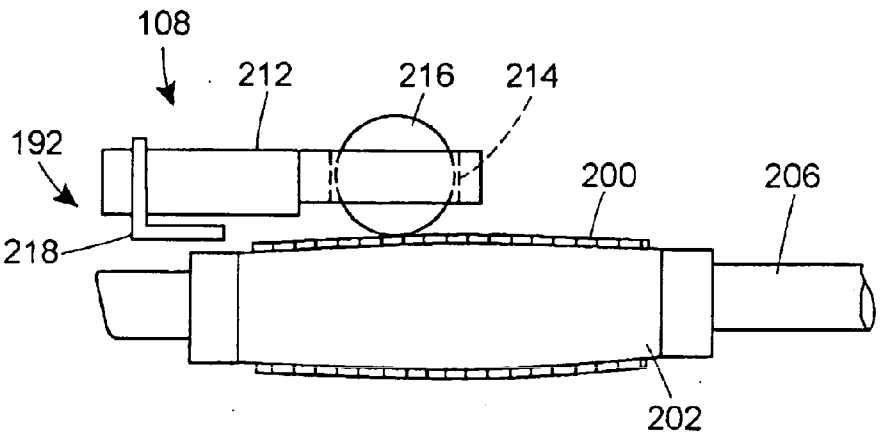
FIG. 9A is a side view of a portion of one possible embodiment of a sheet feeder.
Figure 9B:
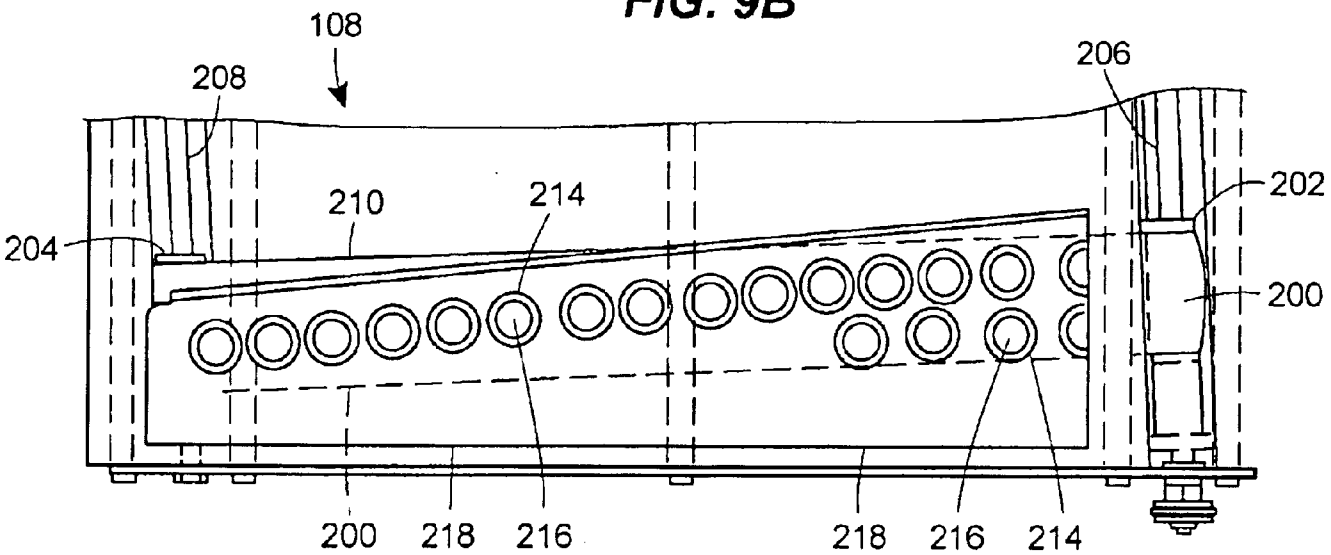
FIG. 9B is a top view of a portion of the sheet feeder of FIG. 9A.

FIGS. 8B, 9A and 9B illustrate one possible embodiment of the sheet feeder 108 shown schematically in FIGS. 6A–6C. Referring to FIG. 8B, the sheet feeder 108 may have a first part in the form of a vacuum drum or roll 190 and a second part in the form of a conveyor 192. The vacuum roll 190, which may be controlled to periodically remove the lowermost sheet from the bottom of the stack of sheets, may be provided in the form of a hollow cylindrical drum having a plurality of holes formed in its cylindrical outer surface and may be positioned directly beneath a rectangular aperture 193 formed in the base plate 170. The vacuum roll 190 may have a hollow interior portion 194 in which a reduced or suction pressure may be selectively provided. To that end, the interior of the vacuum roll 190 may be pneumatically coupled to a vacuum pump (not shown) via a pneumatic line (not shown) and a pneumatic valve (not shown) adapted to selectively open and close the pneumatic line.

FIGS. 9A and 9B illustrate one possible embodiment of the conveyor 192 shown schematically in FIG. 8B. Referring to FIGS. 9A and 9B, the conveyor 192 may have a conveyor belt 200 driven by a pair of spaced rollers 202, 204 each of which may be rotatably driven by a respective drive rod 206, 208. The conveyor 192 may also include a sheet alignment mechanism 210 positioned directly over the conveyor belt 200. The alignment mechanism 210 may include a retainer arm 212 having a plurality of cylindrical bores 214 formed therein, a respective metal ball 216 disposed within each of the bores 214, and an L-shaped side guide 218 connected to the retainer arm 212.

Sheets from the accumulator station 106 may be periodically and individually fed by the vacuum roll 190 to the conveyor 192 so that they pass between the bottom of the metal balls 216 and the top of the conveyor belt 200. The weight of the metal balls 216 resting on top of the sheets may maintain the alignment of the sheets relative to the conveyor belt 200. As shown in FIG. 9B, the side guide 218 may be angled slightly relative to the conveyor belt 200. Consequently, as the sheets pass through the conveyor 192 (from right to left in FIG. 9B), the side edges of the sheets may gradually be moved against the edge of the side guide 218 to cause the side edges of the sheets to become justified or flush against the side guide 218 for proper alignment as the sheets enter the next processing apparatus.

Further details regarding the design and operation of the accumulator 106 and sheet feeder 108 are disclosed in U.S. Pat. No. 6,095,512, which is incorporated herein by reference.

Gluing Apparatus 110

Figure 10:
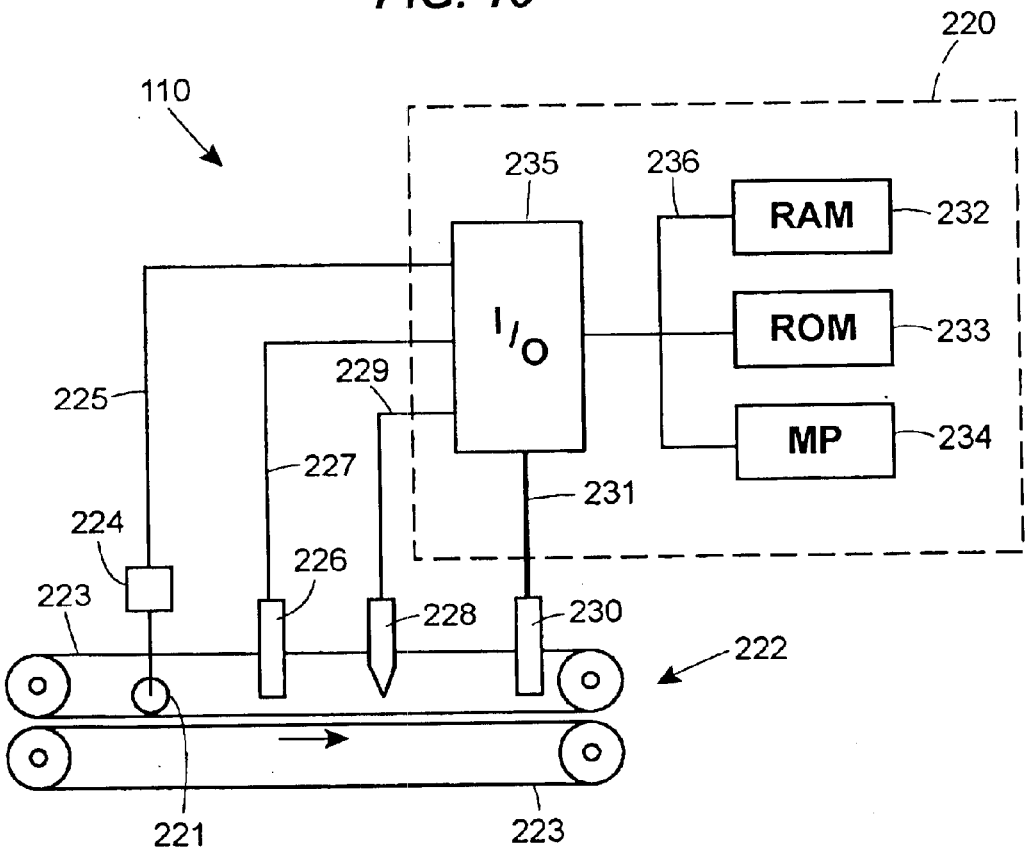
FIG. 10 is a schematic illustration representing various embodiments of a gluer.

Various embodiments of the gluing apparatus 110 shown schematically in FIGS. 6A–6B are described below in connection with FIG. 10. Referring to FIG. 10, the gluing apparatus 110 may include a controller 220, a sensing wheel 221 that may be operatively connected to a conveyor 222, such as by being provided in contact with one of a pair of belts 223 of the conveyor 222, in order to sense the speed of the conveyor 222 and thus the speed at which an article, such as the sheet 20, is being conveyed, a rotary encoder 224 coupled to the sensing wheel 221 and connected to the controller 220 via a signal line 225, a sensor 226 coupled to the controller 220 via a signal line 227 that is capable of detecting the passage of an article through the conveyor 222, one or more glue applicators or nozzles 228, operatively coupled to the controller 220 via one or more signal lines 229, that apply one or more drops of glue to the articles as they pass by, and one or more glue detectors 230 operatively coupled to the controller 220 via one or more signal lines 231.

The conveyor belts 223 may include a plurality of upper and lower conveyor belts 223. The upper conveyor belts 223 may be spaced apart so that a first upper conveyor belt 223 makes contact with a first portion of the article being processed and a second upper conveyor belt 223 makes contact with a second portion of the article, with the two upper conveyor belts 223 having spaces disposed between them and/or on either side to leave exposed the portion(s) of the article to which it is desired to apply the adhesive, so that the glue applicator(s) 228 may apply glue to the desired portion(s) of the article and so that the glue detector(s) 230 may detect the glue applied to the desired portion(s) of the article.

The number of glue applicator(s) 228 used may depend on the width of the article, and if multiple glue applicators 228 are used, either one or more glue detectors 230 may be utilized, depending on the type of glue detector 230 used. For example, where a camera having a relatively large field of view is used as the glue detector 230, only one camera may be necessary where multiple glue applicators 228 are used. Alternatively, a laser scanner, a light sensor, or any other type of detector or sensor, may be used as the glue detector 230. A suitable glue detector is commercially available from HHS America in Dayton, Ohio.

Referring to FIG. 10, the controller 220 may comprise a random-access memory (RAM) 232, a read-only memory (ROM) 233 that may be used as a computer program memory, a microcontroller or microprocessor (MP) 234, and an input/output (I/O) circuit 235, all of which may be interconnected via an address/data bus 236. In that case, a computer program may be stored in the ROM 233 and executed by the microprocessor 234 to control the operation of the glue system 110. The controller 220 may also include an input device, such as a keyboard, and an output device, such as a display device. A suitable controller is commercially available from HHS America in Dayton, Ohio.

It should be appreciated that although only one microprocessor 234 is shown, the controller 220 may include multiple microprocessors 234. Similarly, the memory of the controller 220 may include multiple RAMs 232 and multiple program memories 233. Although the I/O circuit 235 is shown as a single block, it should be appreciated that the I/O circuit 235 may include a number of different types of I/O circuits. The RAM(s) 232 and program memories 233 may be implemented as semiconductor memories, magnetically readable memories, and/or optically readable memories, for example. Alternatively, the controller 220 could be implemented as a logic circuit, a programmable logic array, or another electrical control apparatus or circuit.

One manner in which the glue system 110 may operate is described below in connection with a flowchart which may represent one or more portions of a computer program, which may be stored in one or more of the memories of the controller 220. The computer program portions may be written in any high level language such as C, C+, C++ or the like or any low-level, assembly or machine language. By storing the computer program portions therein, various portions of the memories 232, 233 are physically and/or structurally configured in accordance with computer program instructions.

Figure 12:
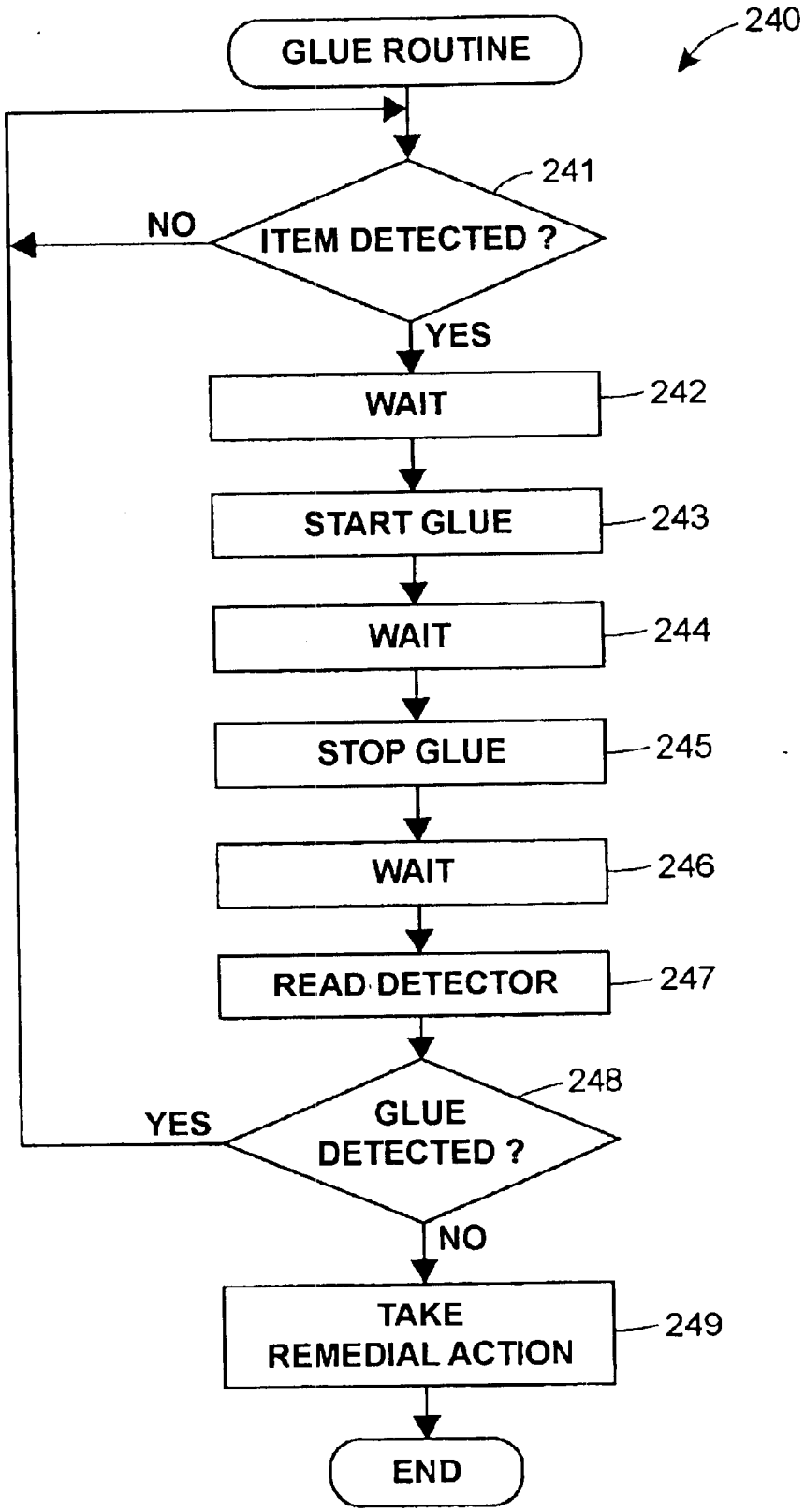
FIG. 12 is a flowchart representing various embodiments of a glue routine.

Various embodiments of a glue routine 240 that may be performed by the controller 220 are described in connection with FIG. 12. Referring to FIG. 12, at block 241, the controller 220 may determine whether an article passing through the conveyor 222 was sensed by the sensor 226. If an article is detected by the sensor 226, at block 242 the controller 220 may wait for a period of time for the article to move from the sensor 226 to beneath the glue applicator 228, which period of time may depend on the path distance between the sensor 226 and the glue applicator 228 and the speed of the conveyor 222.

At the end of the time period, when the article is below the glue applicator 228, at block 243 the controller 220 may cause the adhesive applicator 228 to start the application of glue to the article; the controller 220 may wait a period of time (which may correspond to the desired length of the glue portion to be applied) at block 244; and then the controller 220 may cause the nozzle 228 to stop the application of glue at block 245.

If desired, the controller 220 may verify that the glue was actually applied as intended, in which case the operations of blocks 246–249 could be performed. In particular, at block 246 the controller 220 may wait for a period of time for the article to move from beneath the glue applicator 228 to the glue detector 230, which period of time may depend on the path distance between the glue applicator 228 and the glue detector 230 and the speed of the conveyor 220. At block 247, the controller 220 may read detection data or a detection signal generated by the glue detector 230 to determine whether glue was properly applied to the article via the glue applicator 228. The detection data may vary depending on the type of glue detector utilized. Where a camera is used as the glue detector 230, the detection data may comprise image data corresponding to an image of the field of view of the camera. Where a light sensor is used, the detection data may correspond to the amount of light detected. Alternatively, the glue detector 230 may generate a detection signal that simply indicates whether or not glue was detected.

If glue was not detected as determined at block 248, which indicates a fault condition, at block 249 the controller 220 may take remedial action in response thereto. For example, the controller 220 may cause a warning message to be displayed on a display unit coupled to the controller 220. Alternatively, the controller 220 may cause the processing of articles to cease, for example, by turning off a drive motor M operatively coupled to the controller 220. The main drive motor M may be coupled to drive the conveyor 220 and/or other components of the machine that is forming the booklets 10. If glue was detected at block 248, the operation may return to block 241 to await the passage of another article.

In another embodiment of the glue routine 240, a number of additional operations could be performed to cause remedial action to be taken only in response to the failure to detect the application of glue to a predetermined number of consecutive articles. In that case, the number of consecutive articles to which glue was not applied may be tracked, such as by a COUNT variable. The COUNT variable may be reset to zero if glue was detected on the most recent article (as determined at block 248). If glue was not detected on the most recent article, the value of the COUNT variable may be incremented by one. The value of the COUNT variable may then be compared to determine whether it is greater than a predetermined maximum number or limit, in which case an appropriate remedial action may be taken at block 249 as described above. The number of consecutive articles missing glue that triggers the remedial action may be selected to be any desired number, such as two, three, five, ten, etc.

Although various examples of the glue routine 240 are described above, it should be understood that other routines could be utilized in order to verify that glue was properly applied to the articles being processed. As a further example, if a verification routine were included, the verification routine could determine the percentage of articles to which glue was properly applied. In that case, the verification routine could keep track of the number of articles to which glue was properly applied (as detected by the glue detector 230) and the number of articles to which glue was not properly applied (as detected by the glue detector 230). Upon receiving each signal or set of data from the glue detector 230, the controller 220 could determine the current percentage of articles to which glue was not properly applied. If that percentage is greater than a desired percentage, such as 0.1%, 0.2%, 0.5%, 1%, 2% or a greater percentage, the controller 220 could cause a remedial action to be performed as described above.

Cut/Perf Apparatus 112

Figure 11:
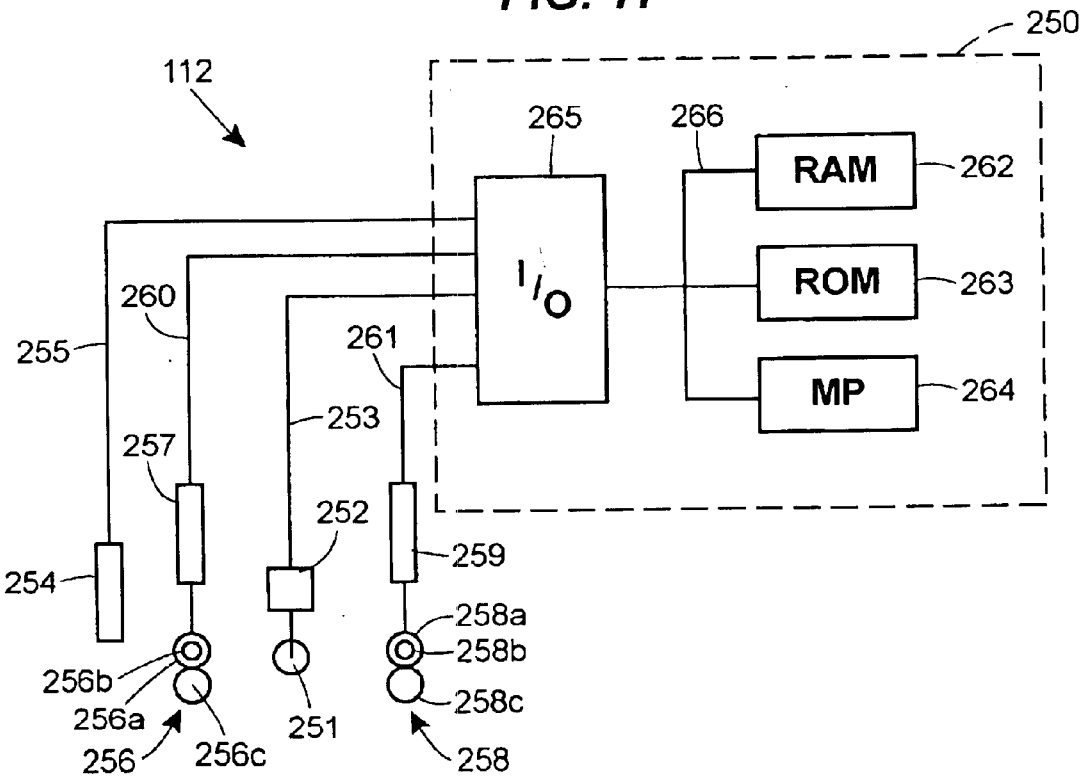
FIG. 11 is a schematic illustration representing various embodiments of a cut/per apparatus.

Various embodiments of the cut/perf apparatus 112 shown schematically in FIGS. 6A–6B are described below in connection with FIG. 11. Referring to FIG. 11, the cut/perf apparatus 112 may include a controller 250, a sensing wheel 251 that may be operatively connected to a conveyor (not shown) in order to sense the speed of the conveyor and thus the speed at which an article, such as the sheet 20, is being conveyed, a rotary encoder 252 coupled to the sensing wheel 251 and connected to the controller 250 via a signal line 253, and a sensor 254 coupled to the controller 250 via a signal line 255 that is capable of detecting the passage of an article through the conveyor.

The cut/perf apparatus 112 may also include a cutting apparatus 256, a movable structure 257, such as a hydraulic or pneumatic piston or a movable support arm, that may support or move the cutting apparatus 256 between a cutting position in which one or more cuts may be made in the article being processed and a retracted non-cutting position, a perforation-forming apparatus 258, and a movable structure 259, such as a hydraulic or pneumatic piston or a movable support arm, that may support or move the perforation-forming apparatus 258 between an operable position in which one or more perforations may be made in the article being processed and a retracted non-operative position. The movement of the support structures 257, 259 may be controlled by the controller 250 via a pair of signal lines 260, 261. For example, where the support structure 257 includes a hydraulic piston and cylinder, the signal line 260 could be used to control an electronic valve that causes movement of the piston by regulating the amount of hydraulic fluid supplied to the cylinder. If the support structure 257 was solenoid operated, the signal line 260 could be used to control the solenoid.

The cutting apparatus 256 may include, for example, a rotatable cutting wheel **256*a* supported by a support member or axle 256*b* and a lower contact member or roller 256*c*. The perforation-forming apparatus 258 may include, for example, a rotatable perforation wheel 258*a* supported by a support member or axle 258*b* and a lower contact member or roller 258*c***.

The controller 250 may comprise a random-access memory (RAM) 262, a read-only memory (ROM) 263 that may be used as a computer program memory, a microcontroller or microprocessor (MP) 264, and an input/output (I/O) circuit 265, all of which may be interconnected via an address/data bus 266. In that case, a computer program may be stored in the ROM 263 and executed by the microprocessor 264 to control the operation of the cut/perf system 112. The controller 250 may also include an input device, such as a keyboard, and an output device, such as a display device.

It should be appreciated that although only one microprocessor 264 is shown, the controller 250 may include multiple microprocessors 264. Similarly, the memory of the controller 250 may include multiple RAMs 262 and multiple program memories 263. Although the I/O circuit 265 is shown as a single block, it should be appreciated that the I/O circuit 265 may include a number of different types of I/O circuits. The RAM(s) 262 and program memories 263 may be implemented as semiconductor memories, magnetically readable memories, and/or optically readable memories, for example. Alternatively, the controller 250 could be implemented as a logic circuit, a programmable logic array, or another electrical control apparatus or circuit.

One manner in which the cut/perf system 112 may operate is described below in connection with a pair of flowcharts which may represent one or more portions of a computer program, which may be stored in one or more of the memories of the controller 250. The computer program portions may be written in any high level language such as C, C+, C++ or the like or any low-level, assembly or machine language. By storing the computer program portions therein, various portions of the memories 262, 263 are physically and/or structurally configured in accordance with computer program instructions.

Figure 13:
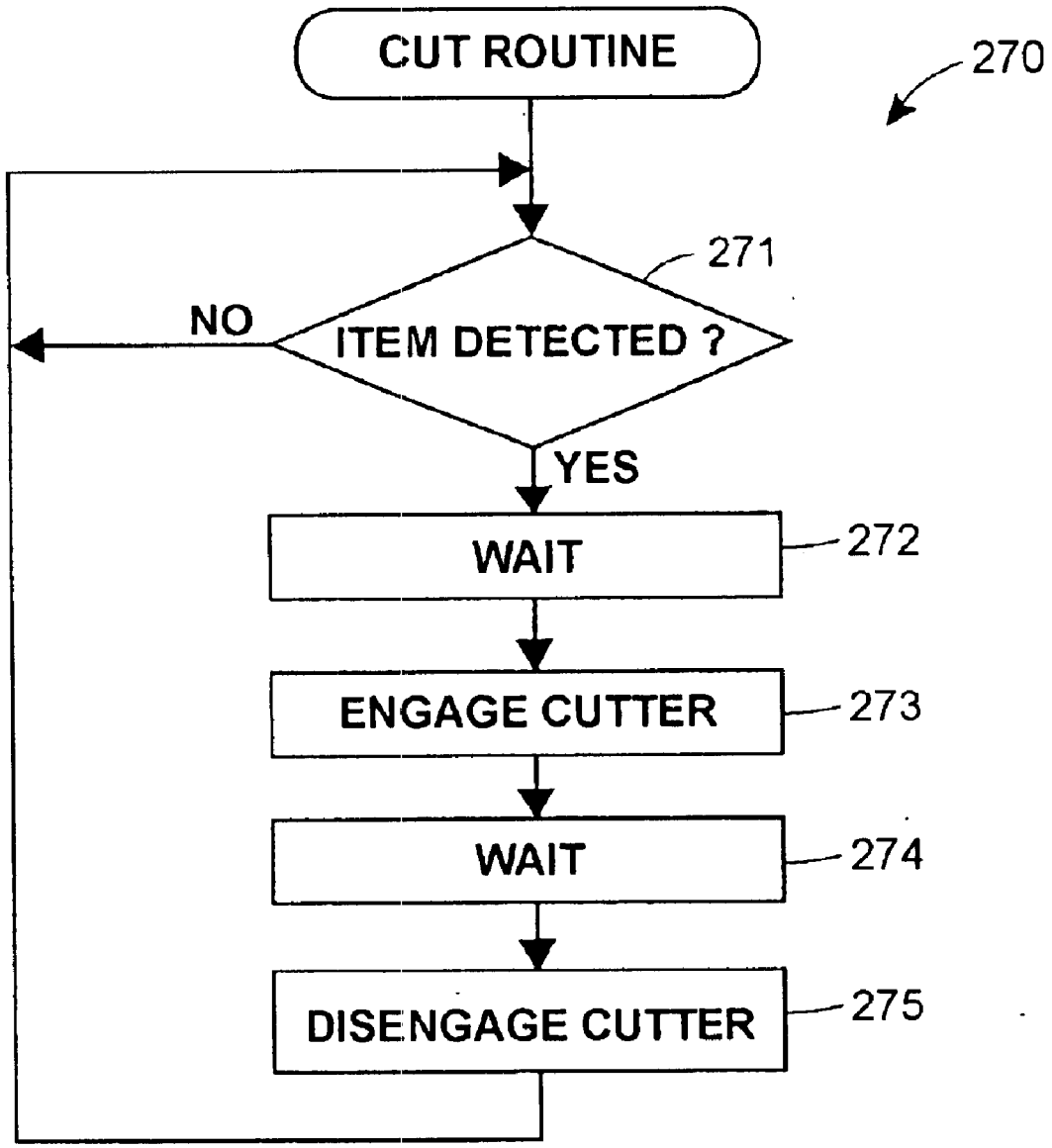
FIG. 13 is a flowchart of one possible embodiment of a cut routine.

One possible embodiment of a cut routine 270 that may be performed by the controller 250 is described below in connection with FIG. 13. Referring to FIG. 13, at block 271, the controller 250 may determine whether an article passing through the cut/perf apparatus 112 was detected by the sensor 254. If an article was detected by the sensor 254, at block 272 the controller 250 may wait for a period of time for the article to move from the sensor 254 to the cutting apparatus 256, which period of time may depend on the path distance between the sensor 254 and the cutting apparatus 256 and the speed of the conveyor.

At the end of the time period, at block 273 the controller 220 may cause the cutting apparatus 256 to engage the article to start the formation of a cut in the article, which may be done by sending an electronic signal to the support structure 257 via the line 260. At block 274, the controller 250 may wait a period of time (which may correspond to the desired length of the cut or cuts), and then at block 275 the controller 250 may cause the cutting apparatus 256 to move to its non-cutting position to stop the cut.

Figure 14:
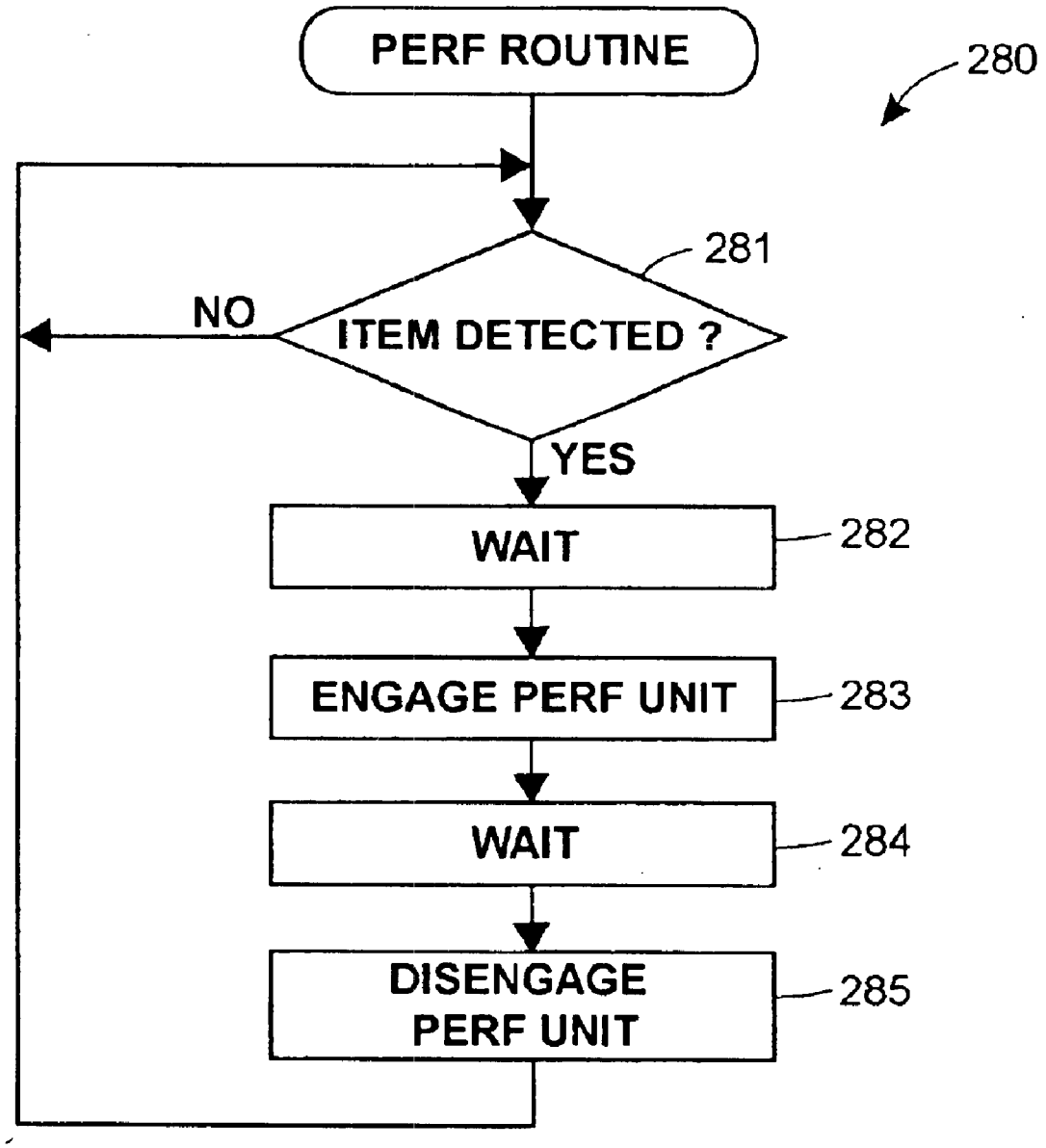
FIG. 14 is a flowchart of one possible embodiment of a perf routine.

FIG. 14 illustrates one possible embodiment of a perforation routine 280 that may be used in connection with the apparatus 112. Referring to FIG. 14, at block 281, the controller 250 may determine whether an article passing through the cut/perf apparatus 112 was detected by the sensor 254. If an article was detected by the sensor 254, at block 282 the controller 250 may wait for a period of time for the article to move from the sensor 254 to the perforation-forming apparatus 258, which period of time may depend on the path distance between the sensor 254 and the apparatus 258 and the speed of the conveyor.

At the end of the time period, at block 283 the controller 220 may cause the perforation-forming apparatus 258 to engage the article to start the formation of a perforation in the article, which may be done by sending an electronic signal to the support structure 259 via the line 261. At block 284, the controller 250 may wait a period of time (which may correspond to the desired length of the perforation or perforations), and then at block 285 the controller 250 may cause the apparatus 258 to move to its non-operative position to stop the perforation.

Although the above embodiments have been described as utilizing a single controller 250 to control the operations shown in FIGS. 13 and 14, it should be understood that different controllers could be utilized. Further, the routines shown in FIGS. 13 and 14 could be combined into a single routine.

Gluing Apparatus 114

The gluing apparatus 114 shown schematically in FIGS. 6A–6C could utilize a controller identical to (or different than) the controller 220 described above in connection with FIG. 10. Alternatively, the gluing apparatus 114 could use the same controller 220.

Figure 15:
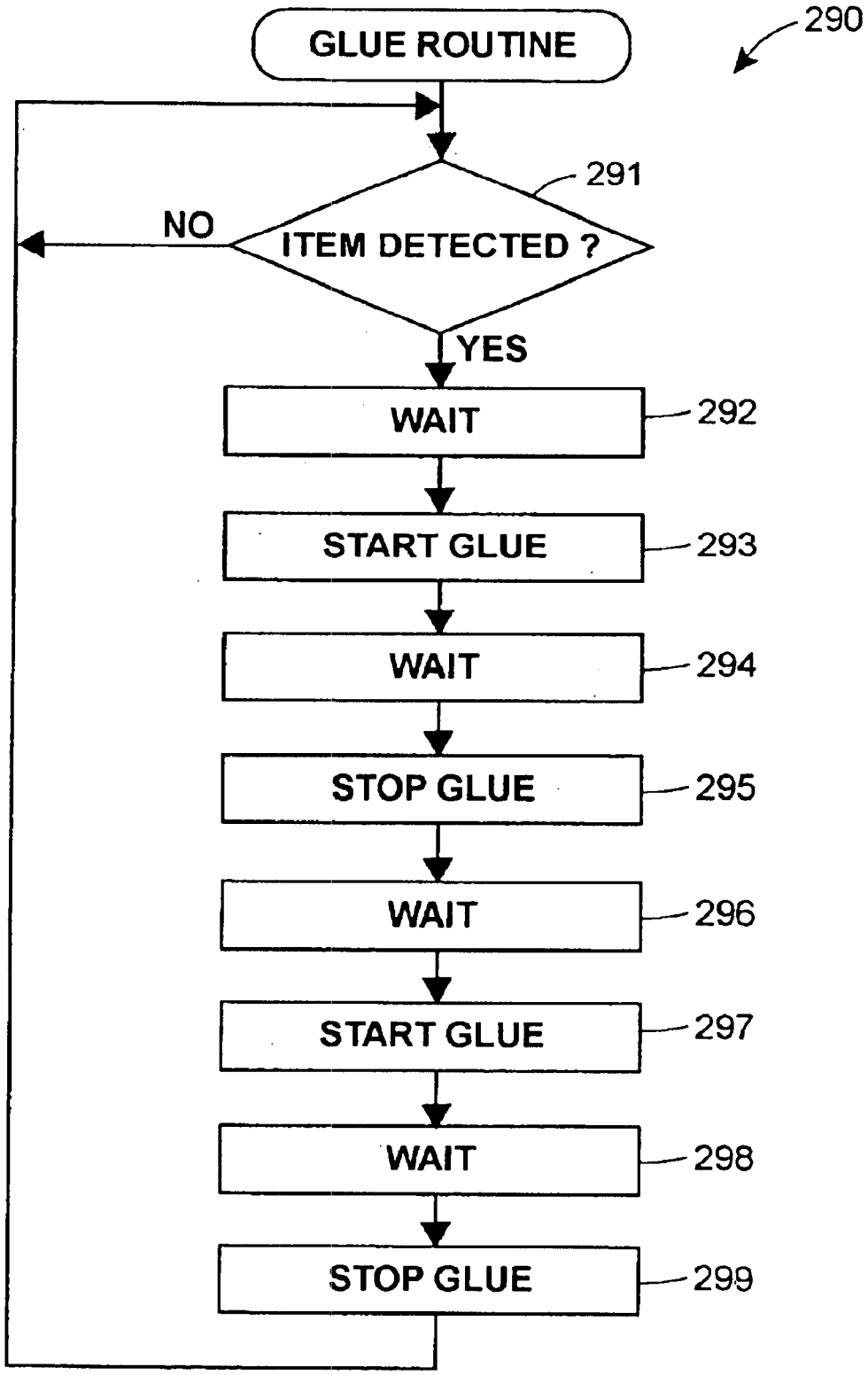
FIG. 15 is a flowchart of one possible embodiment of a glue routine.

Various embodiments of a gluing routine 290 that could be utilized by the gluing apparatus 114 are described below in connection with FIG. 15. Referring to FIG. 15, the glue routine 290 may perform operations at blocks 291–295, which operations may be the same or similar to the operations performed at blocks 241–245 described above. Those operations could be used, for example, to apply adhesive along the line 36*a* shown in FIG. 2B. A similar set of operations may be performed at blocks 296—299 to apply adhesive along a separate line, such as the line 36*b* shown in FIG. 2B. The glue routine 290 could also incorporate various operations designed to verify that glue was properly applied, which operations could be the same or similar to those described above in connection with blocks 246–249.

Folding Unit 116

Figure 16A:
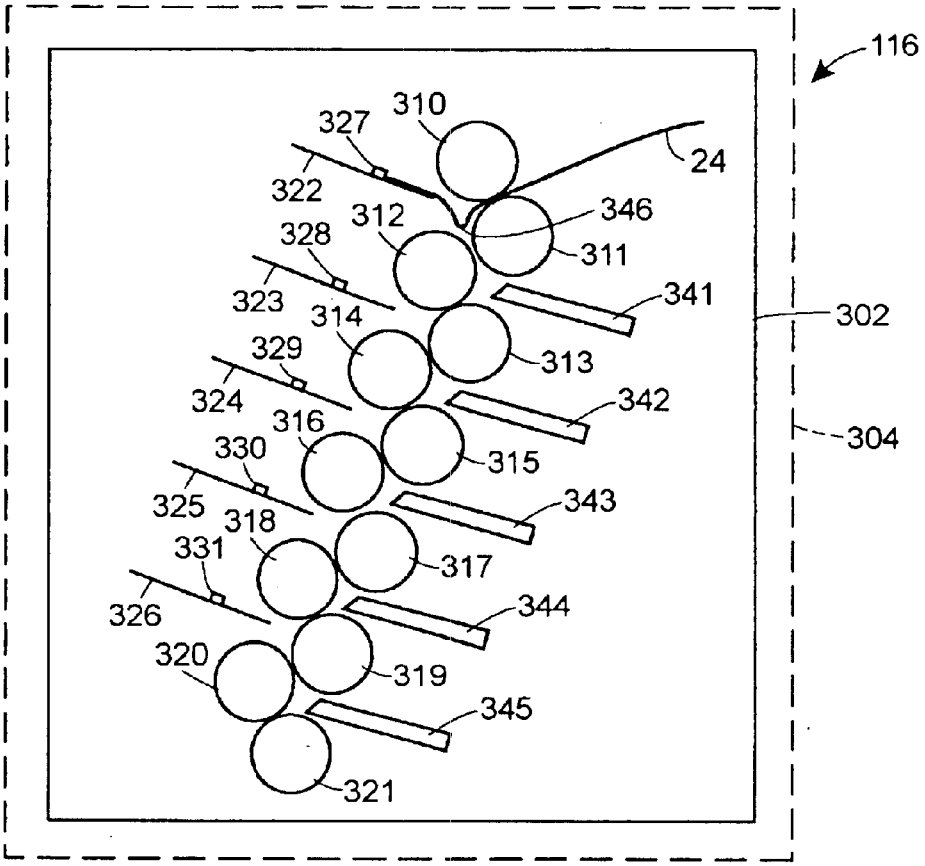
FIGS. 16A and 16B illustrate one possible embodiment of a folding unit.
Figure 16B:
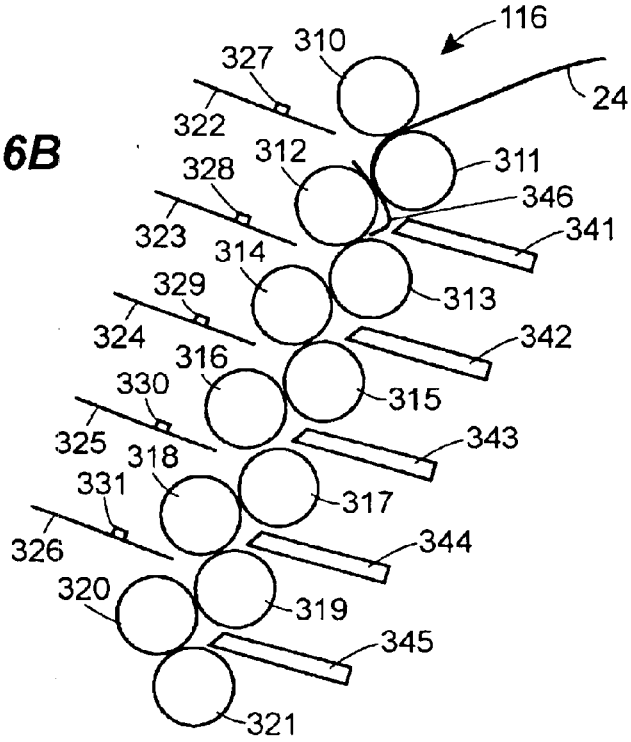

FIGS. 16A and 16B are schematic side views of one possible embodiment of the folding unit 116 shown as a block in FIGS. 6A–6C. The folding unit 116 may be used to make one or more folds in a profiled sheet of paper in a direction perpendicular to the length of the profiled sheet, with all of the folds being parallel to each other. Referring to FIG. 16A, the folding unit 116 may be provided with a pair of spaced apart frame members 302, 304 (not shown in FIG. 16B), a plurality of cylindrical folding rollers 310–321 rotatably supported between the frame members 302, 304, a plurality of folding plates 322–326 each of which may be provided with one of a plurality of stops 327–331 positioned to stop the leading edge or portion of an article, such as sheet or article 24, passing through the folding unit 116 at desired positions, and a plurality of deflectors 341–345, each of which may cause the leading edge or portion of the article 24 passing through the folding unit 116 to be deflected towards the next pair of folding rollers. The folding rollers 310–321 may have non-smooth, knurled or abraded surfaces to facilitate gripping the article 24.

When the leading edge of the sheet 24 enters the folding unit 116 and hits the stop 327, an intermediate portion of the sheet 24 at a point 346 may be forced downwardly towards the nip of the folding rollers 311, 312. When the point 346 passes between the folding rollers 311, 312, the sheet 24 may be folded at the point 346 by the folding rollers 311, 312 and then deflected by the end of the deflector 341 towards the nip of the folding rollers 312, 313, as shown in FIG. 16B.

The process may continue in a similar manner until all of the desired folds are made in the sheet 24. The folding unit 116 shown in FIGS. 16A and 16B would make five folds in the sheet 24. The number of folds and the positions at which they are made could be varied in a known manner by varying the number and/or position of the folding rollers 310–321, the folding plates 322–326 and the deflector plates 341–345.

Although various embodiments of the folding unit 116 are described above, numerous other embodiments and types of folding units could be utilized.

Scoring Unit 118

Figure 19:
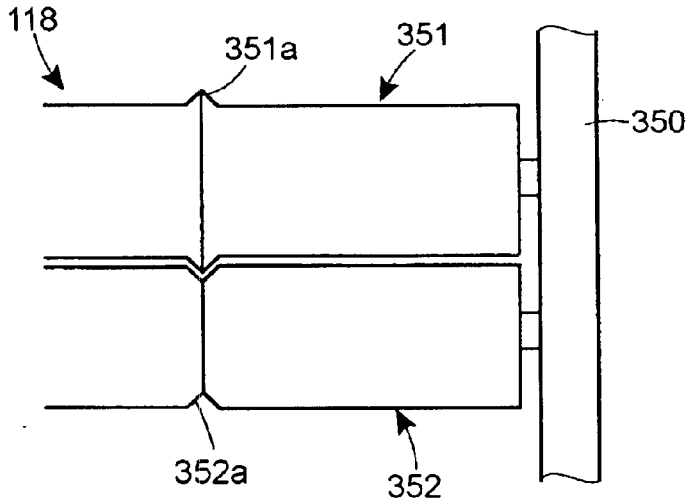
FIG. 19 is an end view illustrating a portion of one possible embodiment of a scoring apparatus.

FIG. 19 illustrates one possible embodiment of the scoring apparatus 118 shown schematically in FIGS. 6A–6B. The scoring apparatus 118 may include a frame or support structure 350 that may support an upper scoring roller 351 and a lower scoring roller 352. The upper scoring roller 351 may be provided with an annular scoring member or raised ridge 351*a*, and the lower scoring roller 352 may be provided with a similarly shaped, annularly shaped scoring depression or trough 352*a*. Other types of scoring apparatuses could be used.

Folding Unit 124

Figure 17A:
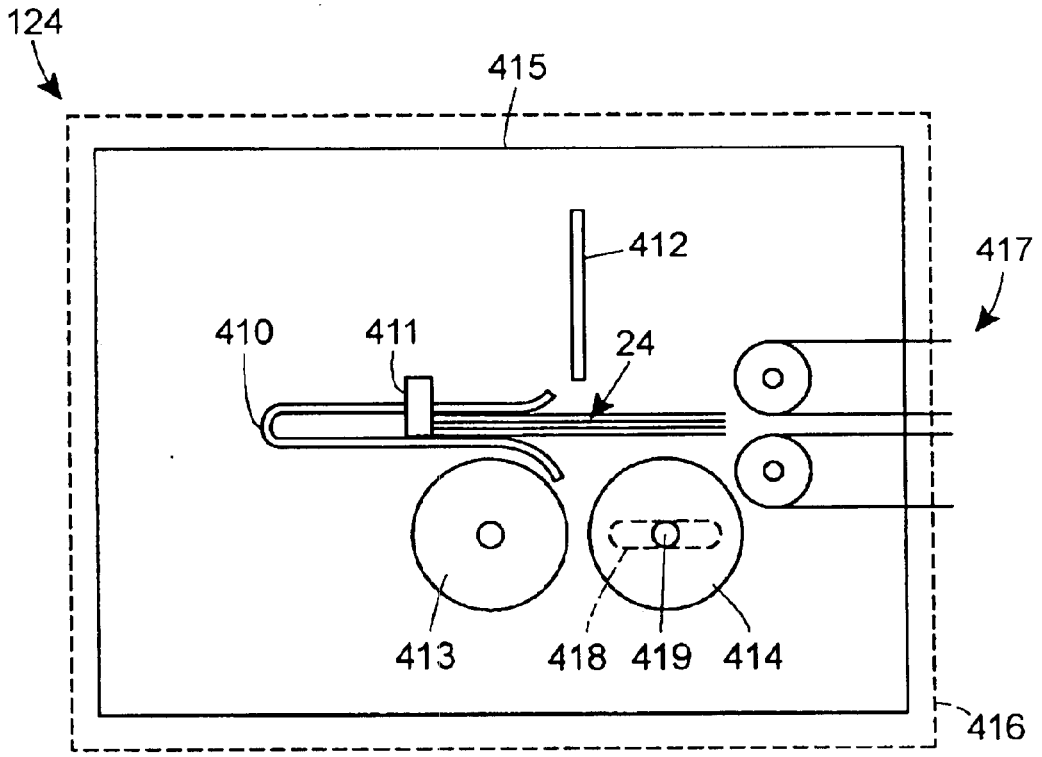
FIGS. 17A and 17B illustrate one possible embodiment of a folding unit.
Figure 17B:
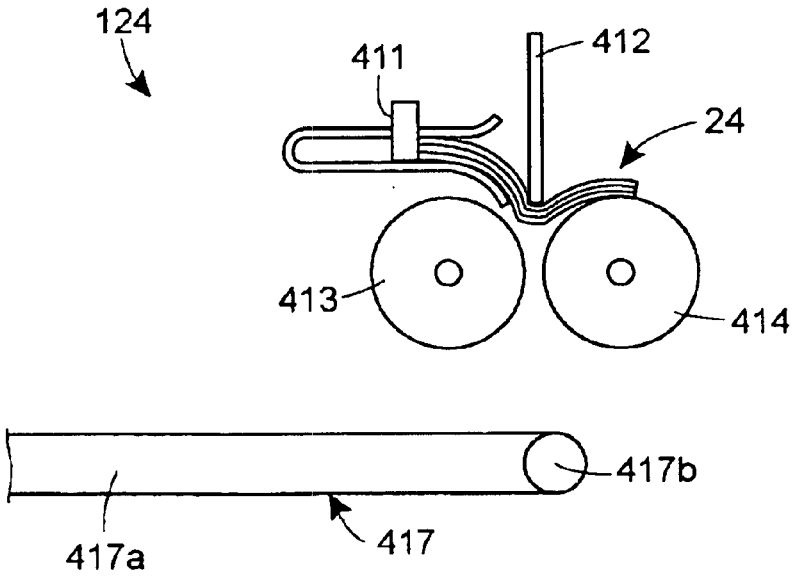

FIGS. 17A and 17B are side views of one possible embodiment of the folding unit 124 shown schematically in FIGS. 6A–6B. The folding unit 124 may be provided with a guide member 410, a stop member 411 associated with the guide member 410, a linearly translatable deflection or knife member 412, a pair of cylindrical folding rollers 413, 414 rotatably mounted between a pair of spaced-apart frame members 415, 416, and one or more conveyors 417.

Each of the frame members 415, 416 (or another support member coupled to the frame members 415, 416) may have a respective horizontally disposed aperture or slot formed 418 therein, and a support or axle portion 419 formed at each end of one of the folding rollers 413, 414 may be supported within the slot 418 to allow the spacing between the outer diameter of each of the folding rollers 413, 414 to be adjusted to accommodate the folding of articles of different thicknesses. The slot 418 could be sized to allow the distance between the outer diameter of the folding roller 413 and the outer diameter of the folding roller 414 to be adjusted to any distance in the range from zero inches to a distance that is up to 0.45 inches (or more) so that the distance may be any distance within that range.

Referring to FIG. 17A, after the article 24 exits the conveyor 417, the leading edge of the article 24 may abut against the stop member 411, and one or more spots of glue may be disposed on one of the tabs 28*b*, 28*c* of the article 24 (the glue may be applied in a manner described above). With the article 24 in that position as shown in FIG. 17A, the bottom edge of the deflection member 412 may be positioned generally in the middle of the article 24 at a point corresponding to the location of the adhesive that bonds the sheets of the article 24 together.

With the article 24 so positioned, the deflection member 412 may be moved downwardly so that it makes contact with an intermediate portion of the article 24 and so that it pushes the intermediate portion towards the nip between the folding rollers 413, 414, as shown in FIG. 17B. As the article 24 passes through the folding rollers 413, 414, the article 24 may be folded (e.g. in half as described above in connection with FIG. 2F) so that the glue spot(s) bond the tabs 28*b*, 28*c* together so that the resulting article remains in a substantially closed orientation.

Figure 18:
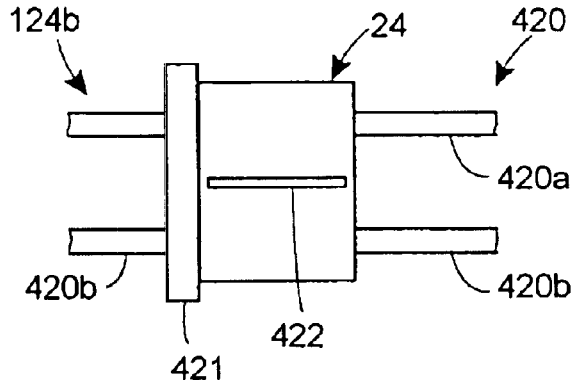
FIG. 18 illustrates another possible embodiment of a folding unit.

A further embodiment of the folding unit 124 is shown in FIG. 18. The folding unit 124*b* of FIG. 18 may be used where a fold is to be made in a direction perpendicular to the leading portion of the article 24. Referring to FIG. 18, the folding unit 124*b* may be provided with a conveyor 420, such as a pair of conveyor belts 420*a*, that move the article 24 from right to left in FIG. 18 until the leading edge of the article 24 makes contact with a stop member 421. With the article 24 disposed in that position, a movable member or blade 422 may move downwards, forcing an intermediate portion of the article 24 between a pair of folding rollers (not shown) disposed beneath the article, with the central axis of each of the folding rollers being disposed in a direction parallel to the length of the blade 422. Movement of the blade 422 may be triggered by detection of the article 24 in the position shown in FIG. 18, which detection could be performed by a sensor (not shown).

Further details regarding folding units that could be used for the folding units 116, 124 are described in U.S. Pat. Nos. 4,616,815, 4,812,195, 4,817,931, 5,044,873, 5,046,710 and 6,273,411, all of which are incorporated herein by reference. Although various embodiments of folding units are described above, numerous other embodiments and types of folding units could be utilized.

Trimming Unit 128

Figure 20:
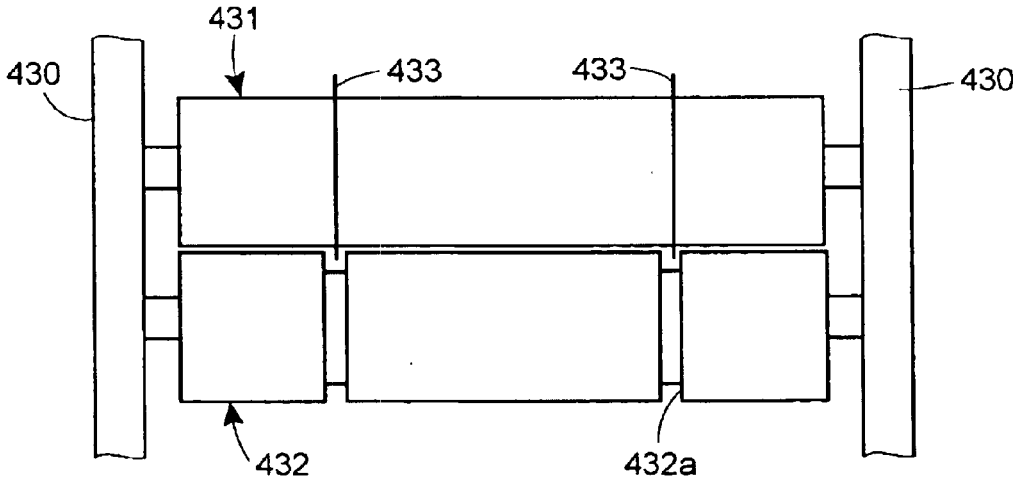
FIG. 20 is an end view illustrating a portion of one possible embodiment of a trimming apparatus.

FIG. 20 illustrates one possible embodiment of the trimming apparatus 128 shown schematically in FIGS. 6A–6B. The trimming apparatus 128 may include a support structure having a pair of frame members 430 that may support an upper trimming roller 431 and a lower trimming roller 432. The upper trimming roller 431 may be provided with one or more trimming members 433, such as annular trimming blades, and the lower trimming roller 432 may be provided with one or more depressions or troughs 432*a* into which the trimming members 432 may extend. Other types of trimming apparatuses could be used.

Bonding Unit 132

Figure 21:
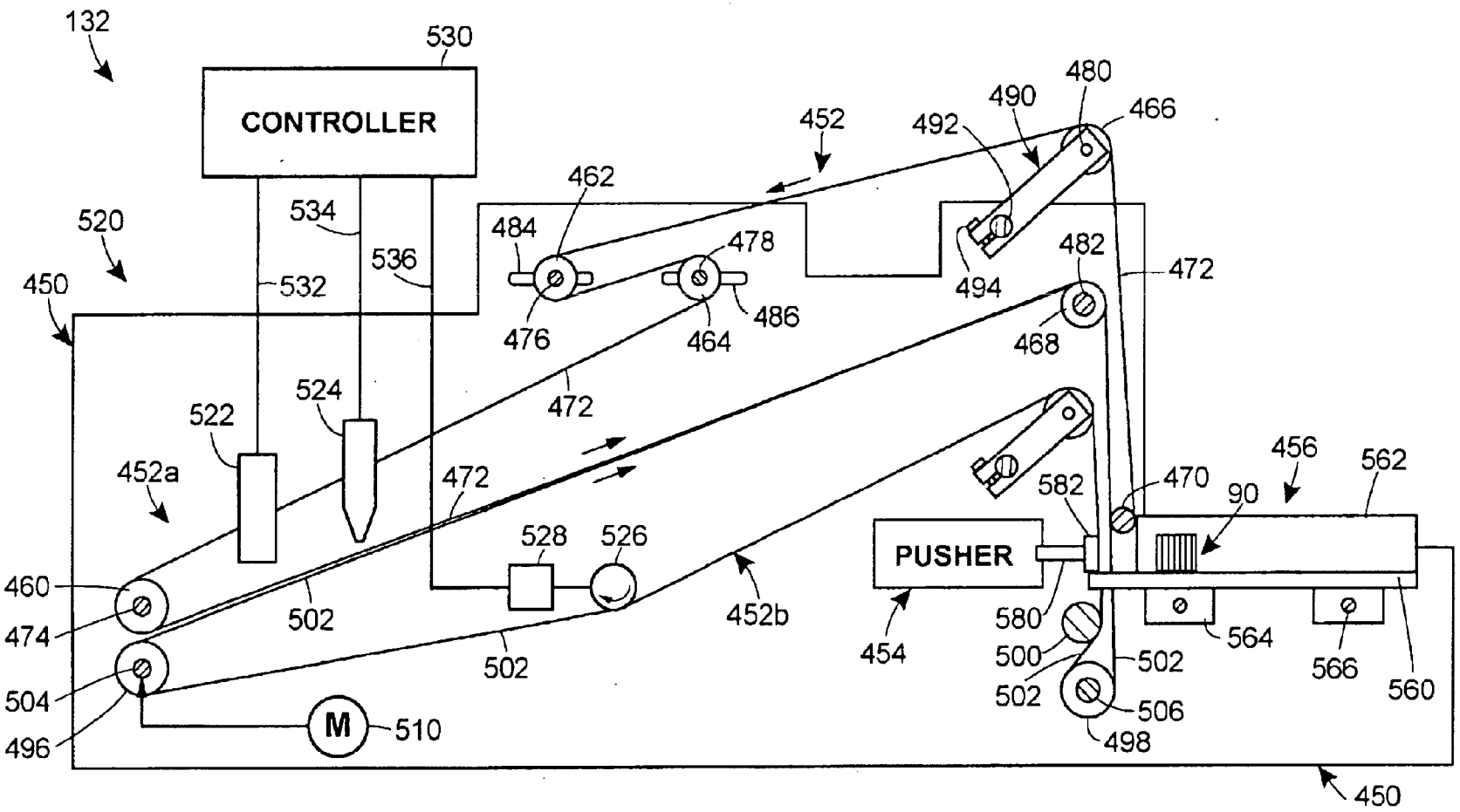
FIGS. 21, 21A and 21B represent various possible embodiments of a bonding unit.

Various possible embodiments of the bonding unit 132 shown schematically in FIG. 6B are described below in connection with FIGS. 21–22B. Referring to FIG. 21, the bonding unit 132 may be provided with a pair of spaced-apart support frames 450, a conveyor unit 452 having an upper conveyor assembly 452*a* and a lower conveyer assembly 452*b*, a pusher unit 454, and a guide tray 456 that supports one or more stacks 90 of booklets 10.

Figure 21A:
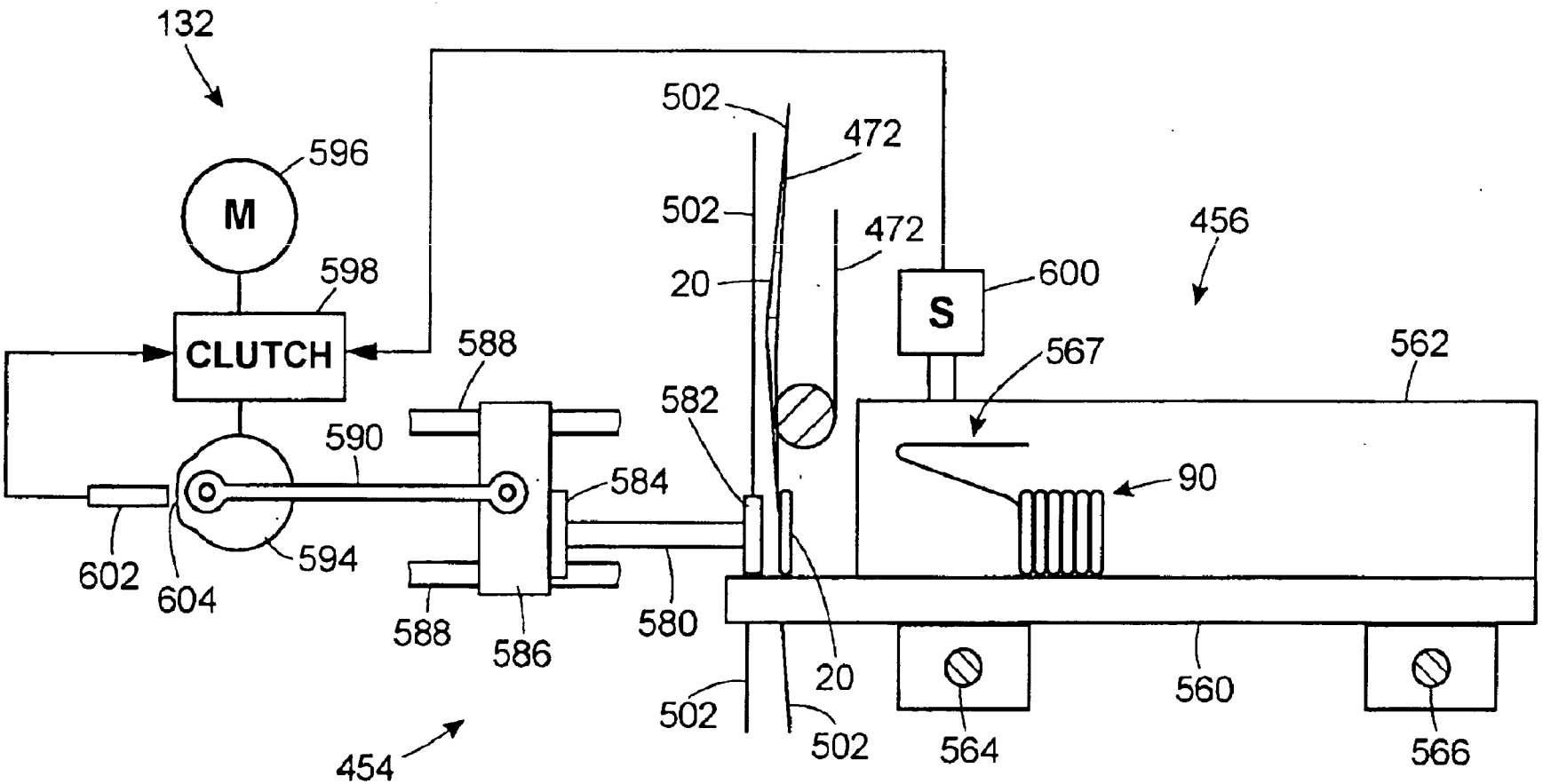
Figure 21B:
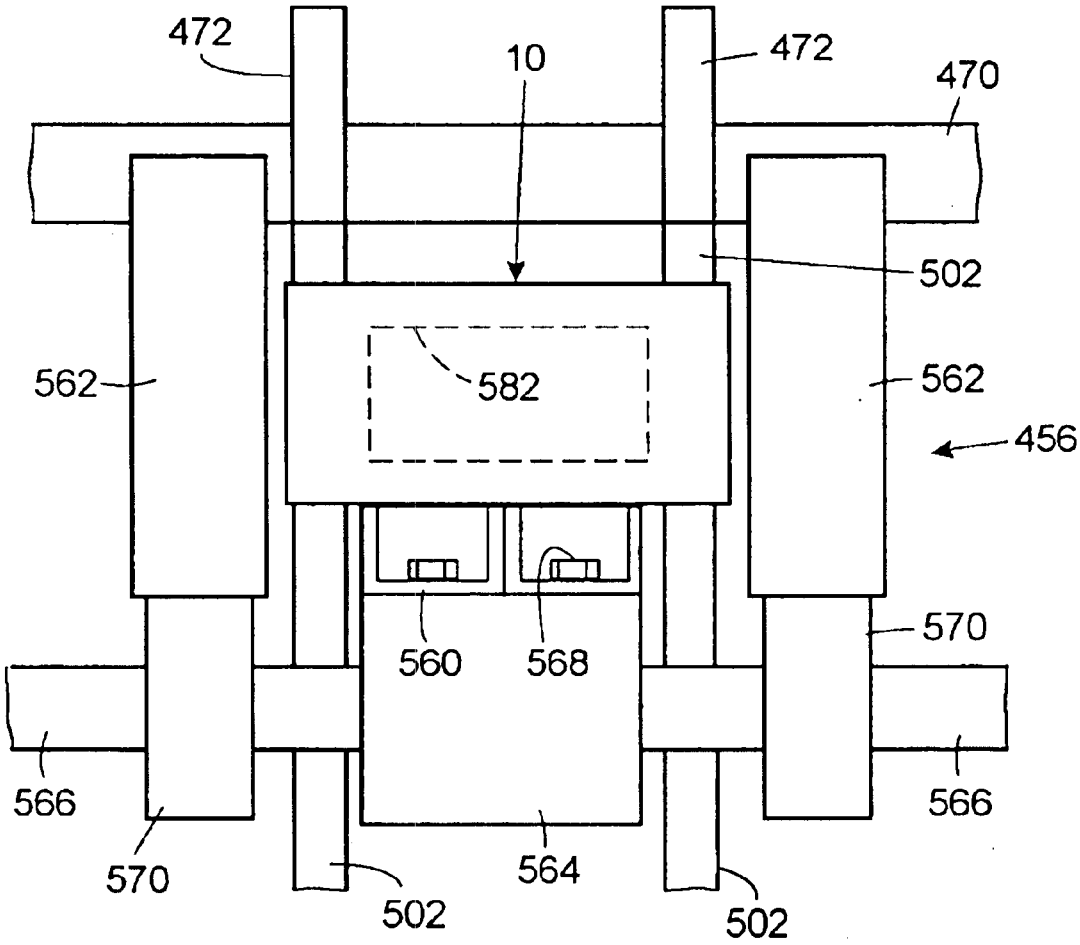

The upper conveyor unit 452*a* may be provided with a plurality of support rollers 460, 462, 464, 466, 468 and a rotatable rod 470 which support a plurality of endless conveyor belts 472. Referring also to FIG. 21B, at least two spaced-apart conveyor belts 472 and two sets of rollers 460, 462, 464, 466, 468 may be utilized. The support rollers 460, 462, 464, 466, 468 may be supported by a plurality of support rods 474, 476, 478, 480, 482 which may be supported by the spaced-apart support frames 450.

The support rods 476, 478 may be disposed through a pair of slots 484, 486 formed in each of the support frames 450 so that the distance between the rollers 462, 464 can be adjusted in order to adjust the tension on the conveyor belts 472. The support rods 476, 478 may be fixed at a particular desired position within the slots 484, 486 by tightening end caps (not shown) threaded onto the ends of the rods 476, 478 or by utilizing other fastening structures.

The rods 480 that support the rollers 466 may be connected to support arms 490 that are fixed to a rod 492 connected between the frame supports 450. The angular position of the support arms 490 may be adjusted and then fixed via tightening bolts 494.

The lower conveyor unit 452*b* may be provided with a plurality of support rollers 496, 498 and a rotatable rod 500 which support a plurality of endless conveyor belts 502. The rollers 468 may support both of the conveyor belts 472, 502. The support rollers 496, 498 may be supported by a plurality of support rods 504, 506, which may be supported by the spaced-apart support frames 450.

The rollers 496 may be fixed to the support rod 504, the support rod 504 may be rotatable, and a motor 510 may be coupled to rotatably drive the support rod 504 via a gearing system (not shown) comprising one or more drive gears. The gearing system may include a pair of intermeshed gears that simultaneously cause the rods 474, 504 to rotate at the same rate in opposite directions so that the conveyor belts 472, 502 are driven in the direction indicated by the arrows in FIG. 21.

The bonding unit 132 may be provided with a glue application system 520. The glue application system 520 may be provided with a sensor 522 that is capable of detecting the passage of booklets 10, one or more glue applicators 524 that apply one or more drops of glue to booklets 10, a sensing wheel 526, a rotary encoder 528, and a controller 530 that is operatively coupled to the sensor 522, the glue applicator(s) 524, and the rotary encoder 528 via a plurality of signal lines 532, 534, 536, respectively.

The adhesive, which may be a cold adhesive or a hot-melt adhesive, may be selected so as to allow easy removal of one of the booklets 10 from the stack 90 without tearing or otherwise damaging the removed booklet 10 or the remaining booklets 10 of the stack 90. One adhesive that may be used is a cold glue adhesive, GMS Part No. GLUE-23704, which is commercially available from Graphic Machinery & Systems of San Rafael, Calif. That adhesive is also marketed by its manufacturer as Capitol Latex Adhesive L179.

Figure 22A:
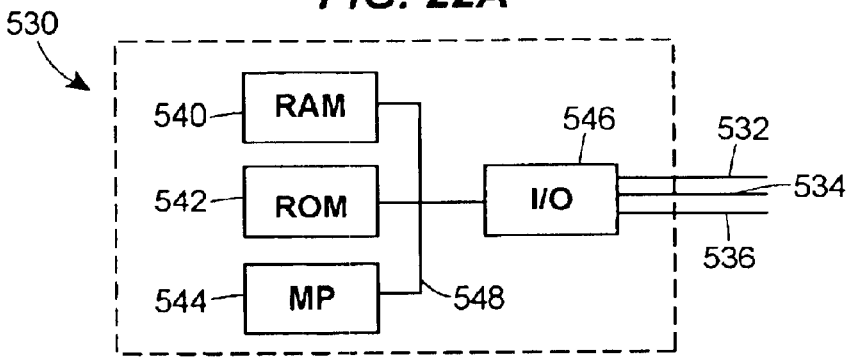
FIG. 22A is a block diagram of one possible embodiment of the controller shown schematically in FIG. 21.

Referring to FIG. 22A, the controller 530 may be provided with a random-access memory (RAM) 540, a program memory such as a read-only memory (ROM) 542, a microprocessor 544, and an input/output (I/O) circuit 546, all of which are interconnected by an address/data bus 548. In that case, a computer program may be stored in the ROM 542 and executed by the microprocessor 544 to control the operation of the glue application system 520. Alternatively, the controller 530 could be implemented as a logic circuit, a programmable logic array, or another electrical control apparatus or circuit.

Referring to FIG. 21, the guide tray 456 may be provided with one or more base members 560 and a plurality of spaced-apart side walls 562. The base members 560 may be supported on a plurality of mounting blocks 564, each of the mounting blocks 564 having a cylindrical hole formed therein through which a cylindrical rod 566 passes. The ends of each of the cylindrical rods 566 may be supported by the spaced-apart support frames 450. As shown in FIG. 21A, the interior face of each of the side walls 562 may be provided with a retention clip 567, which may act to retain the upright position of the rearmost booklet 10 in the stack 90 or which may act to apply a pressure to the rearmost booklet 10 in the stack 90 to facilitate bonding of the rearmost booklet 10 to the stack 90.

Referring to FIG. 21B, which is an end view of the guide tray 456 looking from right to left in FIG. 21A, the base members 560 may have a U-shaped cross section, and the base members 560 may be connected to the mounting blocks 564 via a plurality of bolts 568. The lateral position of the base members 560 may be adjusted by sliding the mounting blocks 564 along the rods 566, and the lateral position may be fixed with a set screw (not shown) or another position-fixing device.

Each of the side walls 562 may be fixed to one or more mounting blocks 570 through which the cylindrical rods 566 pass. The side walls 562 may be spaced apart by a distance substantially corresponding to, or slightly larger than, the width of the stack 90 of booklets 10, as shown in FIG. 21B. The lateral positions of the side walls 562 may also be adjusted by sliding the mounting blocks 570 along the rods 566, and the side walls 562 may be fixed in a particular lateral position via a set screw (not shown) or other means.

Referring to FIG. 21A, the pusher unit 454 may be provided with a laterally extending pusher arm 580 having a pusher plate 582 attached thereto. The pusher arm 580 may be connected to a mounting plate 584 which may in turn be connected to a slide block 586 which is slidably supported by a plurality of slide rods 588. The slide block 586 may be connected to a drive arm 590 having a first end connected to the slide block 586 and a second end connected to a rotatable drive wheel 594. The drive wheel 594 may be rotatably driven by a motor 596 through a clutch mechanism 598.

The clutch 598 may be operatively coupled to a first sensor 600 that detects the presence of one of the booklets 10 as it moves downwardly between the upper and lower conveyor belts 472, 502 and to a second sensor 602 that senses the angular position of the drive wheel 594. For example, the sensor 602 may be a magnetic proximity sensor that detects when an enlarged portion 604 of the drive wheel 594 is adjacent the sensor 602.

Referring to FIG. 21, in the operation of the bonding unit 132, booklets 10 may be automatically provided, one at a time, to the nip or intersection of the upper and lower conveyor belts 472, 502 at the left-hand portion of the bonding unit 132 which is disposed immediately adjacent the support rollers 460, 496. Each time a booklet 10 is introduced between the upper and lower conveyor belts 472, 502, the booklet 10 may be conveyed upwardly due to the frictional contact between the conveyor belts 472, 502 and the booklet 10. As it moves upwardly and to the right in FIG. 21, the booklet 10 may pass underneath the sensor 522, which may detect its presence and transmit a detect signal to the controller 530 via the line 532.

When the booklet 10 passes underneath the adhesive applicator 524, which may be in the form of a nozzle, for example, the adhesive applicator 524 may apply adhesive to the upwardly disposed face of the booklet 10. Whether or not adhesive is applied to the booklet 10 depends upon whether the booklet 10 is to be bonded to a preexisting assembly or stack 90 of booklets being bonded together.

For example, if the bonding unit 132 is to form stacks of booklets 10, with each stack 90 being composed of eight booklets 10 bonded together, the controller 530 may be programmed to cause the adhesive applicator 524 to not apply adhesive to the first booklet 10, then to apply adhesive to the next seven booklets 10 which successively pass underneath the adhesive applicator 524 (causing the first eight booklets 10 to be bonded together). After passage of the first eight booklets 10, the controller 530 could be programmed to then cause the adhesive applicator 524 to skip a single booklet 10 by not applying adhesive thereto, and then to apply adhesive to the next seven consecutive booklets 10.

The precise time at which adhesive is applied by the applicator 524 may be controlled based on the speed of the conveyor belts 472, 502, as sensed by the sensing wheel 526 and transmitted to the controller 530 via the rotary encoder 528, and the known path distance between the sensor 522 and the adhesive applicator 524. Thus, after sensing of a booklet 10 by the sensor 522, the controller 530 may wait a length of time, which varies with the speed of the conveyor belts 472, 502, before signaling the adhesive applicator 524 to deposit adhesive, during which waiting time the position of the booklet 10 will have changed from being beneath the sensor 522 to being beneath the adhesive applicator 524.

After passing underneath the adhesive applicator 524, the booklet 10 continues moving upwardly and to the right between the conveyor belts 472, 502 until it reaches the support wheels 468, after which the booklet 10 may be conveyed downwardly between the belts 472, 502 in a generally vertical direction.

Referring to FIG. 21A, when the booklet 10 reaches a sensing position disposed horizontally adjacent the sensor 600, the sensor 600 may activate the clutch 598 to cause the motor 596 to begin to rotate the drive wheel 594. As the drive wheel 594 rotates, the slide block 586 and the pusher arm 580 and pusher plate 582 which are connected thereto may move from left to right in FIG. 21A.

By the time the pusher plate 582 moves rightwardly past the conveyor belt 502, the booklet 10 will have moved from its sensing position adjacent the sensor 600 to a loading position on top of the ends of the base members 560, which extend between the laterally spaced apart lower conveyor belts 502, as shown in FIGS. 21A and 21B. In the loading position, both faces of the booklet 10 may be disposed vertically, and one of the faces may rest against the conveyor belts 502.

With the booklet 10 in that loading position, the continued rightward movement of the pusher plate 582 may force the booklet 10 from its loading position to a contact position, in which the booklet 10 may be forced against the rearward face of the last (or most leftward) booklet 10 in the stack 90 being formed. If adhesive was deposited on the forward (or rightward) face of the booklet 10, the force applied by the pusher plate 582 may cause the booklet 10 to be bonded to previous booklet 10 in the stack 90.

In order to enhance bonding efficiency, various ways of increasing the force with which the most recent booklet 10 is pushed against the stack 90 may be utilized. For example, the rightward movement of the stack 90 may be retarded by placing a weight, such as a brick or metal plate (not shown) on top of the base members 560 and to the right of the rightmost stack 90 to retard the rightward movement of the stack(s) 10. Alternatively, the base members 560 may be disposed at an inclined angle (their elevation may increase from left to right) to achieve a similar effect.

As the drive wheel 594 continues to rotate, the pusher plate 582 may be retracted back towards its starting position. When the drive wheel 594 reaches its starting position, as sensed by the sensor 602, the clutch 598 may disengage the motor 596 from the drive wheel 594 so that the pusher plate 582 may return to its position shown in FIG. 21A.

It should be understood that the structural details shown in FIG. 21A are not shown to scale and that the stroke length of the pusher plate 582 could be changed by varying the diameter of the drive wheel 594 or by changing the point at which the arm 590 connects to the drive wheel 594. At any one time, there may be multiple booklets 10 in transit within the bonding unit 132 between the starting position and a loading position on top of the base members 560.

Figure 22B:
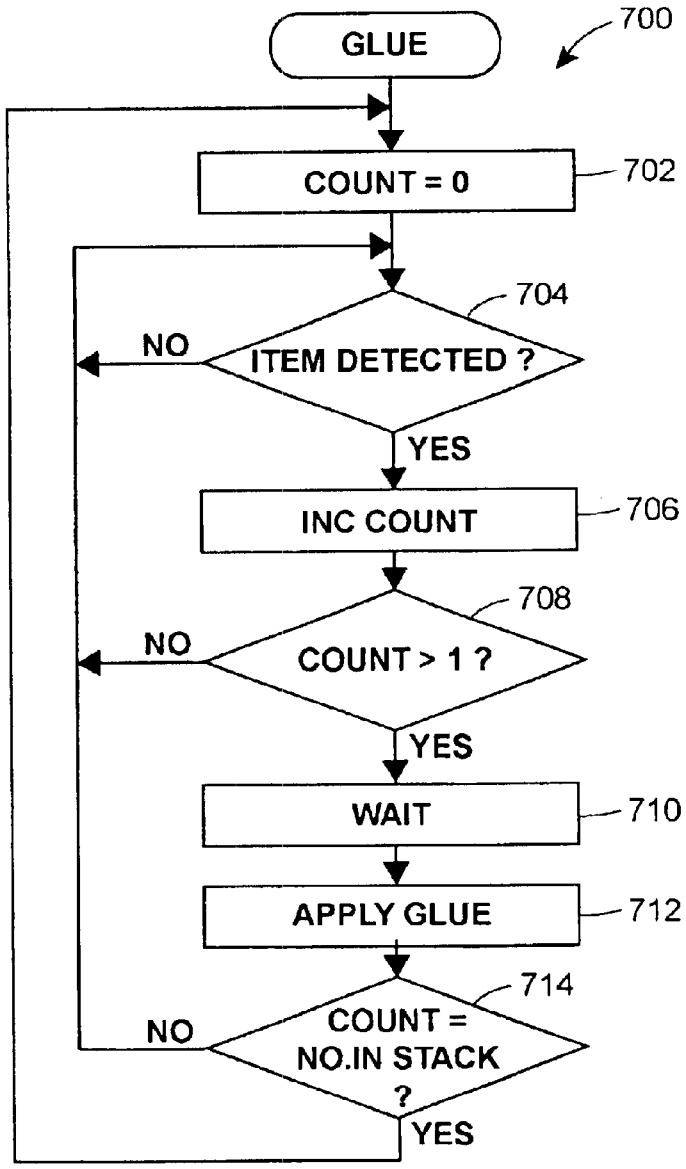
FIG. 22B is a flowchart of one possible embodiment of a glue routine that may be performed during the process of bonding a plurality of booklets together in a stack.

Further details regarding the operation of the controller 530 are shown in FIG. 22B, which illustrates a number of acts that could be performed during a gluing process 700. Referring to FIG. 22B, at block 702 a count variable may be initialized to zero. The count variable may be used to keep track of the number of booklets 10 that pass through the bonding unit 132 as detected by the sensor 522 (FIG. 21). For example, the first booklet 10 in each stack 90 could correspond to a count of one, the third booklet 10 in each stack 90 could correspond to a count of three, etc.

At block 704, the controller 530 may wait until a booklet 10 is detected by the sensor 522. When a booklet 10 is detected, at block 706 the value of count may be incremented by one.

Where adhesive is applied to the leading face of each booklet 10, or the face that is disposed forwardly (to the right in FIGS. 21 and 21A) when the booklet 10 is oriented in a vertical position, adhesive may not be applied to the first booklet 10 of each stack 90 to be formed, but may be applied to every booklet 10 in the stack 90 to be formed that follows the first booklet 10. In that case, at block 708, only if the value of the count variable is greater than one, meaning the current booklet 10 is not the first one in the stack 90, the process passes to blocks 710 and 712 which cause adhesive to be applied to the current booklet 10.

At block 710, the controller 530 may wait for a period of time, which may depend on the path distance between the sensor 522 and the glue applicator 524 and the speed of the upper and lower conveyor belts 472, 502, and then at block 712 the controller 530 may cause the adhesive applicator 524 to apply glue to the moving booklet 10, which was detected at block 704 and which is now positioned underneath the adhesive applicator 524 due to the waiting period of block 710.

At block 714, if the current value of the count variable equals a pre-selected number of booklets 10 to be included in each stack 90, meaning that the current booklet 10 to which glue may have just been applied is the last booklet 10 in the current stack 90, the process may branch back to block 702 where the count variable is reset to zero since the next stack 90 is to be formed. Otherwise, the process may branch back to block 704 to wait for the next booklet 10. Obviously, if adhesive is applied to the opposite face of each of the booklets 10, adhesive would be applied to each booklet 10 in the stack 90 to be formed except for the last booklet 10 in the stack 90.

What is claimed is:

1. A method of forming a booklet having product information printed thereon, said method comprising:

(a) providing a profiled sheet of paper having product information printed thereon, said profiled sheet having a length and comprising a first sheet portion having a width transverse to said length of said profiled sheet and a second sheet portion having a width transverse to said length of said profiled sheet, said first sheet portion having a length parallel to said length of said profiled sheet and said second sheet portion having a length parallel to said length of said profiled sheet, said length of said first sheet portion being greater than said length of said second sheet portion and said width of said second sheet portion being greater than said width of said first sheet portion;

(b) applying an adhesive to a sheet of paper having product information printed thereon;

(c) after (b), folding said profiled sheet by making a plurality of folds in said profiled sheet in a first direction perpendicular to said length of said profiled sheet using a first folding apparatus comprising a plurality of folding rollers to form an intermediate article comprising a plurality of inner sheet panels, an outer sheet panel that corresponds to said second sheet portion of said profiled sheet, a first folded edge parallel to said first direction, and a second folded edge parallel to said first direction, said folds being made so that said outer sheet panel is not disposed between two of said sheet panels and so that each of a plurality of said sheet panels is adhered to at least one other of said sheet panels by said adhesive along a bonded portion of said intermediate article disposed between a first end of said intermediate article and a second end of said intermediate article;

(d) after (c), removing said first and second folded edges of said intermediate article; and (e) after (c), making a fold in said intermediate article along said bonded portion of said intermediate article and in a second direction perpendicular to said first direction using a second folding apparatus comprising a plurality of folding rollers, said fold in said intermediate article being made so that said outer sheet panel forms a pair of outer sheets and so that each of said inner sheet panels forms a pair of inner sheets that are disposed between said outer sheets.

2. A method as defined in claim 1 wherein said profiled sheet is provided by feeding said profiled sheet into said first folding apparatus.

3. A method as defined in claim 1 wherein said profiled sheet is provided by cutting off a plurality of elongate sheet portions from a rectangular sheet.

4. A method as defined in claim 1 wherein said adhesive is applied to said profiled sheet and wherein (b) is performed after (a).

5. A method as defined in claim 1 wherein (a) is performed after (b).

6. A method as defined in claim 1 wherein (d) is performed after (e).

7. A method as defined in claim 1 comprising cutting off said first and second folded edges of said intermediate article.

8. A method as defined in claim 1 additionally comprising providing a removable sheet by omitting application of said adhesive to at least a portion of said removable sheet.

9. A method as defined in claim 1 additionally comprising:

(f) folding a booklet by making a first fold in said booklet, said first fold in said booklet being parallel to said second direction;

(g) depositing an adhesive on a portion of said booklet; and (h) folding said booklet by making a final fold to form a closed booklet, said final fold being parallel to said second direction and being made so that said adhesive deposited at (g) holds said closed booklet in a substantially closed position.

10. A method of forming a booklet having product information printed thereon, said method comprising:

(a) providing a profiled sheet of paper having product information printed thereon, said profiled sheet having a length and comprising a first sheet portion having a width transverse to said length of said profiled sheet, a second sheet portion having a width transverse to said length of said profiled sheet, and a pair of removable tabs formed from part of said second sheet portion, said first sheet portion having a length parallel to said length of said profiled sheet and said second sheet portion having a length parallel to said length of said profiled sheet, said length of said first sheet portion being greater than said length of said second sheet portion and said width of said second sheet portion being greater than said width of said first sheet portion;

(b) applying an adhesive to a sheet of paper having product information printed thereon;

(c) after (b), folding said profiled sheet by making a plurality of folds in said profiled sheet in a first direction perpendicular to said length of said profiled sheet using a first folding apparatus comprising a plurality of folding rollers to form an intermediate article comprising a plurality of inner sheet panels, an outer sheet panel that corresponds to said second sheet portion of said profiled sheet, a first folded edge parallel to said first direction, and a second folded edge parallel to said first direction, said folds being made so that said outer sheet panel is not disposed between two of said sheet panels and so that each of a plurality of said sheet panels is adhered to at least one other of said sheet panels by said adhesive along a bonded portion of said intermediate article disposed between a first end of said intermediate article and a second end of said intermediate article;

(d) after (c), removing said first and second folded edges of said intermediate article; and (e) after (c), making a fold in said intermediate article along said bonded portion of said intermediate article and in a second direction perpendicular to said first direction using a second folding apparatus comprising a plurality of folding rollers, said fold in said intermediate article being made so that said outer sheet panel forms a pair of outer sheets, so that each of said inner sheet panels forms a pair of inner sheets that are disposed between said outer sheets, and so that a portion of each of said tabs is disposed beyond said inner sheets; and (f) after (b), coupling said removable tabs together to maintain said inner sheets in a substantially closed position.

11. A method as defined in claim 10 wherein said profiled sheet is provided by feeding said profiled sheet into said first folding apparatus.

12. A method as defined in claim 10 wherein (b) is performed before (a).

13. A method as defined in claim 10 wherein (d) is performed after (e).

14. A method as defined in claim 10 wherein said removable tabs are coupled together by applying adhesive to one of said removable tabs prior to folding said intermediate article in said second direction.

15. A method as defined in claim 10 wherein said profiled sheet is provided with said removable tabs by providing a weakened link between each of said tabs and a portion of said second sheet portion of said profiled sheet.

16. A method as defined in claim 10 additionally comprising providing a removable sheet by omitting application of said adhesive to at least a portion of said removable sheet.

17. A method as defined in claim 10 additionally comprising:

(g) folding a booklet by making a first fold in said booklet, said first fold in said booklet being parallel to said second direction;

(h) depositing an adhesive on a portion of said booklet; and (i) folding said booklet by making a final fold to form a closed booklet, said final fold being parallel to said second direction and being made so that said adhesive deposited at (h) holds said closed booklet in a substantially closed position.

18. A method of forming a booklet having product information printed thereon, said method comprising:

(a) providing a profiled sheet of paper having product information printed thereon, said profiled sheet having a length and comprising a first sheet portion having a width transverse to said length of said profiled sheet, a second sheet portion having a width transverse to said length of said profiled sheet, and a pair of removable tabs formed from part of said second sheet portion, said first sheet portion having a length parallel to said length of said profiled sheet and said second sheet portion having a length parallel to said length of said profiled sheet, said length of said first sheet portion being greater than said length of said second sheet portion and said width of said second sheet portion being greater than said width of said first sheet portion;

(b) applying an adhesive to a sheet of paper having product information printed thereon;

(c) after (b), folding said profiled sheet by making a plurality of folds in said profiled sheet in a first direction perpendicular to said length of said profiled sheet using a folding apparatus comprising a plurality of folding rollers to form an intermediate article comprising a plurality of inner sheet panels, an outer sheet panel that corresponds to said second sheet portion of said profiled sheet, a first folded edge parallel to said first direction, and a second folded edge parallel to said first direction, said folds being made so that said outer sheet panel is not disposed between two of said sheet panels and so that each of a plurality of said sheet panels is adhered to at least one other of said sheet panels by said adhesive along a bonded portion of said intermediate article;

(d) after (b), coupling said removable tabs together to maintain said inner sheet panels in a substantially closed position; and (e) after (c), removing said first and second folded edges of said intermediate article.

19. A method as defined in claim 18 wherein said profiled sheet is provided by feeding said profiled sheet into said folding apparatus.

20. A method as defined in claim 18 wherein said adhesive is applied to said profiled sheet and wherein (b) is performed after (a).

21. A method as defined in claim 18 wherein (a) is performed after (b).

22. A method as defined in claim 18 wherein said removable tabs are coupled together by applying adhesive to one of said removable tabs prior to making at least one of said folds in said profiled sheet.

23. A method as defined in claim 18 wherein said profiled sheet is provided with said removable tabs by providing a weakened link between each of said tabs and a portion of said second sheet portion of said profiled sheet.

24. A method as defined in claim 18 wherein said method additionally comprises:

(f) folding a booklet by making a first fold in said booklet, said first fold in said booklet being parallel to said second direction;

(g) depositing an adhesive on a portion of said booklet; and (h) folding said booklet by making a final fold to form a closed booklet, said final fold being parallel to said second direction and being made so that said adhesive deposited at (g) holds said closed booklet in a substantially closed position.

* * * * *